US011149220B2

(12) United States Patent
Hodgkins et al.

(10) Patent No.: US 11,149,220 B2
(45) Date of Patent: Oct. 19, 2021

(54) PROCESS AND SYSTEM FOR HYDROGENATION, HYDROCRACKING AND CATALYTIC CONVERSION OF AROMATIC COMPLEX BOTTOMS

(71) Applicant: Saudi Arabian Oil Company, Dhahran (SA)

(72) Inventors: Robert Peter Hodgkins, Dhahran (SA); Omer Refa Koseoglu, Dhahran (SA); Frederick Marie Adam, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 70 days.

(21) Appl. No.: 16/790,541

(22) Filed: Feb. 13, 2020

(65) Prior Publication Data

US 2021/0253962 A1 Aug. 19, 2021

(51) Int. Cl.

| | |
|---|---|
| ***C10G 69/12*** | (2006.01) |
| ***C10G 47/30*** | (2006.01) |
| ***C10G 49/22*** | (2006.01) |

(52) U.S. Cl.

CPC ..... *C10G 69/123* (2013.01); *C10G 47/30* (2013.01); *C10G 49/22* (2013.01); *C10G 2300/1055* (2013.01); *C10G 2300/1096* (2013.01); *C10G 2300/4006* (2013.01); *C10G 2300/4012* (2013.01); *C10G 2300/4018* (2013.01); *C10G 2400/28* (2013.01); *C10G 2400/30* (2013.01)

(58) Field of Classification Search

CPC .... C10G 11/18; C10G 51/026; C10G 57/005; C10G 69/04; C10G 2300/107; C10G 2300/1077; C10G 2300/301; C10G 2300/305; C10G 2300/307; C10G 2300/308; C10G 2400/02; C10G 2400/04; C10G 2400/20; B01J 8/1827; B01J 19/245; B01J 2219/0004; B01D 3/14

See application file for complete search history.

(56) References Cited

U.S. PATENT DOCUMENTS

| | | | |
|---|---|---|---|
| 2,301,391 | A | 11/1942 | Frey |
| 2,373,501 | A | 4/1945 | Peterson |
| 2,389,713 | A | 11/1945 | Atwell |

(Continued)

FOREIGN PATENT DOCUMENTS

| | | | |
|---|---|---|---|
| CA | 1137118 | A1 | 12/1982 |
| CA | 1168647 | A1 | 6/1984 |

(Continued)

OTHER PUBLICATIONS

Kari Vahteristo, Kinetic Modeling of Mechanisms of Industrially Important Organic Reactions in Gas and Liquid Phase, (2010) Lappeenranta University of Technnology (Acta Universitatis Lappeenrantaensis 402).

(Continued)

*Primary Examiner* — Brian A McCaig

(74) *Attorney, Agent, or Firm* — Abelman, Frayne & Schwab

(57) ABSTRACT

Processes and systems are disclosed for improving the yield from reforming processes. Aromatic complex bottoms, or a heavy fraction thereof, are subjected to hydrogenation/hydrocracking, followed by catalytic conversion, to produce additional gasoline and higher-quality aromatic compounds.

33 Claims, 6 Drawing Sheets

(56) References Cited

U.S. PATENT DOCUMENTS

| | | | | |
|---|---|---|---|---|
| 3,172,842 | A | | 3/1965 | Paterson |
| 3,197,518 | A | | 7/1965 | Chapman et al. |
| 3,435,084 | A | | 3/1969 | Cabbage et al. |
| 3,591,651 | A | | 7/1971 | Carr et al. |
| 3,617,494 | A | | 11/1971 | Montgomery |
| 3,625,879 | A | | 12/1971 | Horne et al. |
| 3,836,344 | A | | 9/1974 | Krawitz et al. |
| 4,022,681 | A | | 5/1977 | Sheng et al. |
| 4,078,990 | A | | 3/1978 | Brennan et al. |
| 4,127,471 | A | * | 11/1978 | Suggitt ..... C07C 4/12 208/135 |
| 4,211,886 | A | | 7/1980 | Tabak et al. |
| 4,300,008 | A | | 11/1981 | McCauley |
| 4,382,851 | A | | 5/1983 | Angevine et al. |
| 4,645,585 | A | | 1/1987 | White |
| 5,004,853 | A | | 4/1991 | Barger et al. |
| 5,149,894 | A | | 9/1992 | Holtermann et al. |
| 5,189,233 | A | | 2/1993 | Larkin et al. |
| 5,210,333 | A | | 5/1993 | Bellows et al. |
| 5,294,334 | A | | 3/1994 | Kaul et al. |
| 5,382,734 | A | | 1/1995 | Sardar et al. |
| 5,773,670 | A | | 6/1998 | Gilbert et al. |
| 5,830,345 | A | | 11/1998 | Lee et al. |
| 5,856,602 | A | | 1/1999 | Gilbert et al. |
| 6,187,980 | B1 | | 2/2001 | Gilbert |
| 6,187,987 | B1 | | 2/2001 | Chin et al. |
| 6,448,436 | B1 | | 9/2002 | Kreitman et al. |
| 6,958,425 | B1 | | 10/2005 | Bogdan et al. |
| 7,091,390 | B2 | | 8/2006 | Jan et al. |
| 7,638,667 | B2 | | 12/2009 | Jan et al. |
| 7,687,423 | B2 | | 3/2010 | Moscoso et al. |
| 7,745,678 | B2 | | 6/2010 | Jan et al. |
| 8,927,800 | B2 | | 1/2015 | Mahieux et al. |
| 9,145,522 | B2 | | 9/2015 | Negiz et al. |
| 9,221,036 | B2 | | 12/2015 | Koseoglu et al. |
| 9,283,553 | B2 | | 3/2016 | Kim et al. |
| 9,328,299 | B2 | | 5/2016 | Funk et al. |
| 9,382,173 | B2 | | 7/2016 | Yanagawa et al. |
| 9,862,898 | B2 | | 1/2018 | Ward et al. |
| 10,053,401 | B1 | | 8/2018 | Beadle et al. |
| 10,081,009 | B2 | | 9/2018 | Koseoglu et al. |
| 10,093,873 | B2 | | 10/2018 | Koseoglu et al. |
| 10,357,761 | B2 | | 7/2019 | Koseoglu et al. |
| 2013/0240406 | A1 | | 9/2013 | Sadler et al. |
| 2016/0045841 | A1 | | 2/2016 | Kaplan et al. |
| 2017/0009156 | A1 | | 1/2017 | Pelaez |
| 2018/0066197 | A1 | | 3/2018 | Koseoglu et al. |

FOREIGN PATENT DOCUMENTS

| | | | |
|---|---|---|---|
| CA | 2356632 | A1 | 6/2000 |
| WO | 2009008879 | A1 | 1/2009 |

OTHER PUBLICATIONS

Tung-Hsiung Kuo and Chuei-Tin Chang, Application of Mathematic Programming Model for Integrated Planning and Scheduling of Petroleum Supply Networks, Industrial & Engineering Chemistry Research (2008), vol. 47, No. 6, pp. 1935-1954.

G. C. Laredo, P. Pérez-Romo, J. Escobar, J. L. Garcia-Gutierrez, and P. M. Vega-Merino, Light Cycle Oil Upgrading to Benzene, Toluene, and Xylenes by Hydrocracking: Studies Using Model Mixtures, Industrial & Engineering Chemistry Research (2017), vol. 56, No. 39, pp. 10939-10948.

M. Chareonpanich, Z.-G. Zhang, and A. Tomita, Hydrocracking of aromatic hydrocarbons over USY-zeolite, Energy & Fuels (1996), vol. 10, No. 4, pp. 927-931.

PCT International Search Report and Written Opinion from corresponding PCT Application No. PCT/US2021/016277 dated May 10, 2021.

* cited by examiner

PROCESS AND SYSTEM FOR HYDROGENATION, HYDROCRACKING AND CATALYTIC CONVERSION OF AROMATIC COMPLEX BOTTOMS

RELATED APPLICATIONS

Not applicable.

BACKGROUND OF THE INVENTION

Field of the Invention

This disclosure relates to catalytic reforming and aromatics recovery processes integrating conversion of aromatic complex bottoms including heavy alkylated aromatics into aromatic products and/or gasoline blending components.

Description of Related Art

Catalytic reformers are used in refineries to produce reformate, which is used as an aromatic rich gasoline blending fraction, and/or is used as feedstock to produce aromatic products. Due to stringent fuel specifications currently implemented or set for implementation worldwide, for example, requiring a level of ≤35 V % aromatics and a level of ≤1 V % benzene in gasoline, the reformate fraction is further treated to reduce its aromatics content. Treatment options for reduction of aromatics content include benzene hydrogenation and aromatics extraction. In benzene hydrogenation, the reformate is selectively hydrogenated to reduce the benzene content, and the total aromatics content is reduced by blending, if necessary.

In some refineries, naphtha is reformed after hydrodesulfurization to increase the octane content of the gasoline. Reformate contains a high level of benzene which must be reduced in order to meet requisite fuel specifications that are commonly in the range of from about 1-3 V % benzene, with certain geographic regions targeting a benzene content of less than 1 V %. Catalytic reforming, which involves a variety of reactions in the presence of one or more catalysts and recycle and make-up hydrogen, is a widely used process for refining hydrocarbon mixtures to increase the yield of higher octane gasoline. However, benzene yields can be as high as 10 V % in reformates. There currently exist methods to remove benzene from reformate, including separation processes and hydrogenation reaction processes. In separation processes, benzene is extracted with a solvent and then separated from the solvent in a membrane separation unit or other suitable unit operation. In hydrogenation reaction processes, the reformate is divided into fractions to concentrate the benzene, and then one or more benzene-rich fractions are hydrogenated.

In catalytic reforming, a naphtha stream is first hydrotreated in a hydrotreating unit to produce a hydrotreated naphtha stream. The hydrotreating unit operates according to certain conditions, including temperature, pressure, hydrogen partial pressure, liquid hourly space velocity (LHSV), and catalyst selection and loading, which are effective to remove at least enough sulfur and nitrogen to meet requisite product specifications. For instance, hydrotreating in conventional naphtha reforming systems generally occurs under relatively mild conditions that are effective to remove sulfur and nitrogen to less than 0.5 ppmw levels.

The hydrotreated naphtha stream is reformed in a reforming unit to produce a gasoline reformate product stream. The reformate is sent to the gasoline pool to be blended with other gasoline components to meet the required specifications. Some gasoline blending pools include $C_4$ and heavier hydrocarbons having boiling points of less than about 205° C. In catalytic reforming processes, paraffins and naphthenes are restructured to produce isomerized paraffins and aromatics of relatively higher octane numbers. Catalytic reforming converts low octane n-paraffins to i-paraffins and naphthenes. Naphthenes are converted to higher octane aromatics. The aromatics are left essentially unchanged, or some may be hydrogenated to form naphthenes due to reverse reactions taking place in the presence of hydrogen. The reactions involved in catalytic reforming are commonly grouped into the four categories of cracking, dehydrocyclization, dehydrogenation, and isomerization. A particular hydrocarbon/naphtha feed molecule may undergo more than one category of reaction and/or may form more than one product.

There are several types of catalytic reforming process configurations which differ in the manner in which they regenerate the reforming catalyst to remove the coke formed in the reactors. Catalyst regeneration, which involves combusting detrimental coke in the presence of oxygen, includes a semi-regenerative process, cyclic regeneration, and continuous catalyst regeneration (CCR). Semi-regeneration is the simplest configuration, and the entire unit, including all reactors in the series, is shut-down for catalyst regeneration in all reactors. Cyclic configurations utilize an additional "swing" reactor to permit one reactor at a time to be taken off-line for regeneration while the others remain in service. Continuous catalyst regeneration configurations, which are the most complex, provide for essentially uninterrupted operation by catalyst removal, regeneration and replacement. While continuous catalyst regeneration configurations include the ability to increase the severity of the operating conditions due to higher catalyst activity, the associated capital investment is necessarily higher.

Reformate is usually sent to an aromatic complex (also referred to as an "aromatics recovery complex" or ARC) for extraction of the aromatics. Reformate generally undergoes several processing steps in an aromatic complex to recover high value products including xylenes and benzene. In addition lower value products, for example toluene, can be converted into higher value products. The aromatics present in reformate are typically separated into different fractions by carbon number, such as $C_6$ benzene, $C_7$ toluene, $C_8$ xylenes and ethylbenzene. The $C_8$ fraction is typically subjected to a processing scheme to produce high value para-xylene. Para-xylene is usually recovered in high purity from the $C_8$ fraction by separating the para-xylene from the ortho-xylene, meta-xylene, and ethylbenzene using selective adsorption or crystallization. The ortho-xylene and meta-xylene remaining from the para-xylene separation are isomerized to produce an equilibrium mixture of xylenes. The ethylbenzene is isomerized into xylenes or is dealkylated to benzene and ethane. The para-xylene is separated from the ortho-xylene and the meta-xylene, typically using adsorption or crystallization. The para-xylene-free stream is recycled to extinction to the isomerization unit, and in the para-xylene recovery unit ortho-xylene and meta-xylene are converted to para-xylene and recovered.

Toluene is recovered as a separate fraction, and then may be converted into higher value products, for example, benzene in addition to or in alternative to xylenes. One toluene conversion process involves the disproportionation of toluene to make benzene and xylenes. Another process involves the hydrodealkylation of toluene to produce benzene. Both toluene disproportionation and toluene hydrodealkylation result in the formation of benzene. With the current and future anticipated environmental regulations involving benzene, it is desirable that the toluene conversion does not result in the formation of significant quantities of benzene.

The aromatic complex produces a reject stream or bottoms stream that is very heavy (typically boiling higher than about 150° C.), which is not suitable as gasoline blending components. Maximum sulfur, aromatics, and benzene levels of about 10 ppmw, 35 V %, and 1 V % or less, respectively, have been targeted as goals by regulators.

A problem faced by refinery operators is how to most economically utilize the aromatic complex bottoms. In some refineries, the aromatic complex bottoms are added to the gasoline fraction. However, the aromatic complex bottoms deteriorate the gasoline quality and in the long run impact the engine performance negatively, and any portion not added to the gasoline fraction is considered process reject material. Therefore, a need exists for improved systems and processes for handling aromatic complex bottoms.

SUMMARY

The above objects and further advantages are provided by the systems and processes for treating aromatic complex bottoms streams disclosed herein. In a conventional aromatic complex for separating heavy reformate, BTX/BTEX is recovered, but up to 20% of the heavy reformate comprises material that is typically considered process reject material or bottoms.

In embodiments herein, systems and processes for treatment of $C_9$+ aromatic complex bottoms are provided. These are obtained from catalytic reforming of naphtha followed by separation in an aromatic complex into a gasoline pool stream, an aromatic products stream and the $C_9$+ aromatic complex bottoms. In certain embodiments, the process comprises reacting a feedstream comprising all or a portion of the $C_9$+, the $C_{10}$+ or the $C_{11}$+ aromatic bottoms in the presence of hydrogenation catalyst, hydrocracking catalyst and hydrogen under specified reaction conditions to a produce a liquid effluent stream that is hydrogenated and hydrocracked. The hydrogenated/hydrocracked liquid effluent stream is reacted in the presence of a catalyst under specified fluidized catalytic cracking reaction conditions generally to produce FCC naphtha, light olefins and cycle oil.

In certain embodiments, the process comprises separating all or a portion of the $C_9$+ aromatic bottoms into a tops fraction and a bottoms fraction; and reacting a feedstream comprising all or a portion of the bottoms fraction in the presence of a hydrogenation catalyst, hydrocracking catalyst and hydrogen, and the hydrogenated/hydrocracked liquid effluent stream is reacted in the presence of a catalyst under specified fluidized catalytic cracking reaction conditions. A portion of the $C_9$+ aromatic bottoms can be subjected to hydrogenation and hydrocracking, bypassing separation. In certain embodiments all or a portion of the tops fraction is supplied to a reactor in the presence of a transalkylation catalyst and hydrogen under specified reaction conditions for transalkylation of aromatics to produce $C_8$ aromatic compounds.

In certain of the above embodiments, the aromatic complex includes a xylene rerun unit, and the feedstream to hydrogenation/hydrocracking and/or separation comprises C9+ alkylaromatics from the xylene rerun unit. In certain of the above embodiments, the aromatic complex includes or is in fluid communication with a transalkylation zone for transalkylation of aromatics to produce $C_8$ aromatic compounds and $C_{11}$+ aromatic compounds, and the hydrogenation feedstream comprises $C_{11}$+ aromatics from the transalkylation zone.

In certain of the above embodiments, the process further comprises passing all or a portion of the FCC naphtha stream to catalytic reforming, to the aromatic complex, or to a naphtha hydrotreating zone that precedes catalytic reforming. In certain of the above embodiments, the aromatic complex includes a reformate splitter operable to separate reformate into light reformate stream and a heavy reformate stream, and a heavy reformate splitter operable to separate heavy reformate into a $C_7$ stream and a $C_8$+ stream, and where the process further comprises passing all or a portion of the FCC naphtha stream to the heavy reformate splitter. In certain of the above embodiments, the process further comprises separating all or a portion of the FCC naphtha into an aromatics (BTX/BTEX) stream and additional gasoline or additional gasoline blending components.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The process of the present disclosure will be described in more detail below and with reference to the attached drawings in which.

DETAILED DESCRIPTION

Figure 1A:
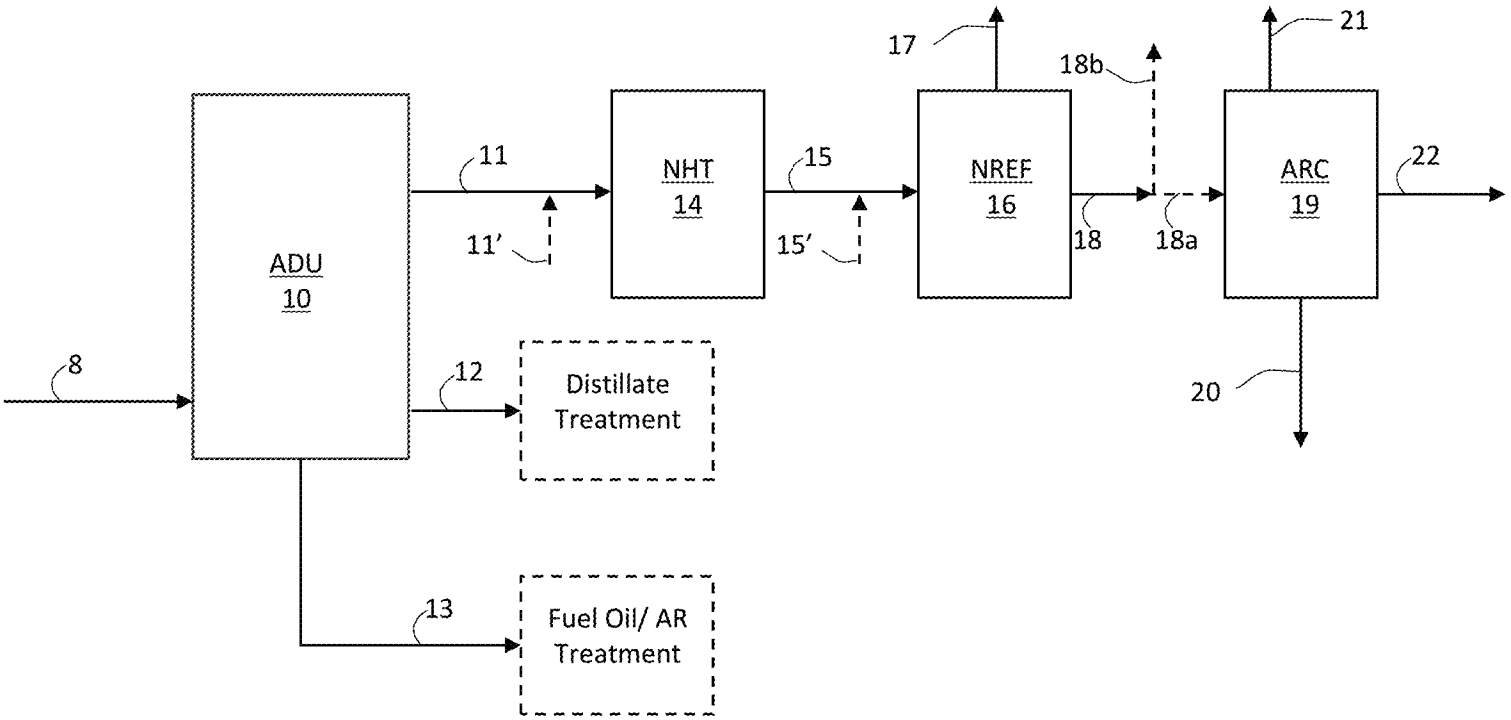
FIG. 1A (Prior Art)
FIG. 1A is a schematic process flow diagram of a conventional system for gasoline and aromatic production.

As used herein, the term "stream" (and variations of this term, such as hydrocarbon stream, feedstream, product stream, and the like) may include one or more of various hydrocarbon compounds, such as straight chain, branched or cyclical alkanes, alkenes, alkadienes, alkynes, alkylaromatics, alkenyl aromatics, condensed and non-condensed di-, tri- and tetra-aromatics, and gases such as hydrogen and methane, C2+ hydrocarbons and further may include various impurities.

The term "zone" refers to an area including one or more equipment, or one or more sub-zones. Equipment may include one or more reactors or reactor vessels, heaters, heat exchangers, pipes, pumps, compressors, and controllers. Additionally, an equipment, such as reactor, dryer, or vessels, further may be included in one or more zones.

Volume percent or "V %" refers to a relative value at conditions of 1 atmosphere pressure and 15° C.

The phrase "a major portion" with respect to a particular stream or plural streams, or content within a particular stream, means at least about 50 W % and up to 100 W %, or the same values of another specified unit.

The phrase "a significant portion" with respect to a particular stream or plural streams, or content within a particular stream, means at least about 75 W % and up to 100 W %, or the same values of another specified unit.

The phrase "a substantial portion" with respect to a particular stream or plural streams, or content within a particular stream, means at least about 90, 95, 98 or 99 W % and up to 100 W %, or the same values of another specified unit.

The phrase "a minor portion" with respect to a particular stream or plural streams, or content within a particular stream, means from about 1, 2, 4 or 10 W %, up to about 20, 30, 40 or 50 W %, or the same values of another specified unit.

The modifying term "straight run" is used herein having its well-known meaning, that is, describing fractions derived directly from the atmospheric distillation unit, optionally subjected to steam stripping, without other refinery treatment such as hydroprocessing, fluid catalytic cracking or steam cracking. An example of this is "straight run naphtha" and its acronym "SRN" which accordingly refers to "naphtha" defined herein that is derived directly from the atmospheric distillation unit, optionally subjected to steam stripping, as is well known.

The term "naphtha" as used herein refers to hydrocarbons boiling in the range of about 20-220, 20-210, 20-200, 20-190, 20-180, 20-170, 32-220, 32-210, 32-200, 32-190, 32-180, 32-170, 36-220, 36-210, 36-200, 36-190, 36-180 or 36-170° C.

The term "light naphtha" as used herein refers to hydrocarbons boiling in the range of about 20-110, 20-100, 20-90, 20-88, 32-110, 32-100, 32-90, 32-88, 36-110, 36-100, 36-90 or 36-88° C.

The term "heavy naphtha" as used herein refers to hydrocarbons boiling in the range of about 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

The term "diesel range distillates" as used herein relative to effluents from the atmospheric distillation unit or separation unit refers to middle and heavy distillate hydrocarbons boiling between the end point of the naphtha range and the initial point of the atmospheric residue, such as in the range of about 170-370, 170-360, 170-350, 170-340, 170-320, 180-370, 180-360, 180-350, 180-340, 180-320, 190-370, 190-360, 190-350, 190-340, 190-320, 200-370, 200-360, 200-350, 200-340, 200-320, 210-370, 210-210, 210-350, 210-340, 210-320, 220-370, 220-220, 220-350, 220-340 or 220-320° C.; sub-fractions of middle and heavy distillates include kerosene, diesel and atmospheric gas oil.

The term "atmospheric residue" and its acronym "AR" as used herein refer to the bottom hydrocarbons having an initial boiling point corresponding to the end point of the diesel range distillates, and having an end point based on the characteristics of the crude oil feed.

The term "reformate" as used herein refers to a mixture of hydrocarbons that are rich in aromatics, and are intermediate products in the production of chemicals and/or gasoline, and include hydrocarbons boiling in the range of about 30-220, 40-220, 30-210, 40-210, 30-200, 40-200, 30-185, 40-185, 30-170 or 40-170° C.

The term "light reformate" as used herein refers to hydrocarbons boiling in the range of about 30-110, 30-100, 30-90, 30-88, 40-110, 40-100, 40-90 or 40-88° C.

The term "heavy reformate" as used herein refers to hydrocarbons boiling in the range of about 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

As used herein, the term "aromatic products" includes $C_6$-$C_8$ aromatics, such as benzene, toluene, mixed xylenes (commonly referred to as BTX), or benzene, toluene, ethylbenzene and mixed xylenes (commonly referred to as BTEX), and any combination thereof. These aromatic products (referred to in combination or in the alternative as BTX/BTEX for convenience herein) have a premium chemical value.

As used herein, the terms "aromatic complex bottoms" and "aromatic bottoms" are used interchangeably and include hydrocarbons that are derived from an aromatic complex. These include the heavier fraction of $C_9$+ aromatics such as $C_9$-$C_{16}$+ compounds, and include a mixture of compounds including di-aromatics, for example in the range of $C_{10}$-$C_{16}$+ aromatic components. For example, aromatic bottoms generally boil in the range of greater than about 110 or 150° C., in certain embodiments in the range of about 110-500, 150-500, 110-450 or 150-450° C.

The term "mixed xylenes" refers to a mixture containing one or more $C_8$ aromatics, including any one of the three isomers of di-methylbenzene and ethylbenzene.

FIG. 1A is a schematic process flow diagram of a typical system and process for conversion of naphtha into gasoline and aromatic products integrating a naphtha hydrotreating zone 14, a catalytic reforming zone 16 and an aromatic complex 19. The system is shown in the context of a refinery including an atmospheric distillation column 10 having one or more outlets discharging a naphtha fraction 11 such as straight run naphtha, one or more outlets discharging diesel range distillates, shown as stream 12, and one or more outlets discharging an atmospheric residue fraction 13.

Naphtha conversion includes the naphtha hydrotreating zone 14, the catalytic reforming zone 16, and the aromatic complex 19. The naphtha hydrotreating zone 14 includes one or more inlets in fluid communication with the naphtha fraction 11 outlet(s), and one or more outlets discharging a hydrotreated naphtha stream 15. The catalytic reforming zone 16 includes one or more inlets in fluid communication with the hydrotreated naphtha stream 15 outlet(s), one or more outlets discharging a hydrogen rich gas stream 17, and one or more outlets discharging a reformate stream 18. In certain embodiments, the source of naphtha that is passed to the naphtha hydrotreating zone 14 can include a source other than the naphtha fraction 11, which in certain embodiments is straight run naphtha. Such other sources, which can be used instead of or in conjunction with the naphtha fraction 11, are generally indicated in FIG. 1A as stream 11', and can be derived from one or more sources of naphtha such as a wild naphtha stream obtained from a hydrocracking operation, a coker naphtha stream obtained from thermal cracking operations, pyrolysis gasoline obtained from steam cracking operations, or FCC naphtha (which can be from the integrated FCC unit or from another FCC unit). In still further embodiments, any naphtha stream that has sufficiently low heteroatom content can be passed directly to the catalytic reforming zone 16, generally indicated in FIG. 1A as stream 15'.

In certain embodiments, a portion 18*b* of the reformate can optionally be used directly as a gasoline blending pool component. All of stream 18, or a portion 18*a* in embodiments where a portion 18*b* is drawn off as a gasoline blending pool component, is used as feed to the aromatic complex 19. In certain embodiments, the portion 18*a* can be a heavy reformate fraction and the portion 18*b* can be a light reformate fraction. The aromatic complex 19 includes one or more inlets in fluid communication with the outlet(s) discharging the reformate stream 18 or the portion 18*a* thereof, and includes one or more outlets discharging gasoline pool stream(s) 21, one or more outlets discharging aromatic products stream(s) 22, and one or more outlets discharging an aromatic bottoms stream 20 that contains $C_9$+ aromatic hydrocarbon compounds.

An initial feed such as crude oil stream 8 is distilled in the atmospheric distillation column 10 to recover a naphtha or a heavy naphtha fraction 11 such as straight run naphtha or straight run heavy naphtha, and other fractions including for instance one or more diesel range distillate fractions, shown as stream 12, and an atmospheric residue fraction 13. Typically stream 12 includes at least one or more middle and/or heavy distillate fractions that are treated, such as by hydrotreating. Such treatment is referred to in FIG. 1A as "distillate treatment," and can include one or more separate hydrotreating units to desulfurize and obtain a diesel fuel fraction meeting the necessary specifications (for instance, ≤10 ppm sulfur). The atmospheric residue fraction 13 is typically either used as fuel oil component or sent to other separation and/or conversion units to convert low value hydrocarbons to high value products, shown in FIG. 1A as "fuel oil/AR treatment".

The stream(s) 11 and/or 11' are hydrotreated in the naphtha hydrotreating zone 14 in the presence of hydrogen to produce the hydrotreated stream 15. The naphtha hydrotreating zone 14 operates in the presence of an effective amount of hydrogen, which can be obtained from recycle within the naphtha hydrotreating zone 14, recycle reformer hydrogen 17 (not shown), and if necessary, make-up hydrogen (not shown). A suitable naphtha hydrotreating zone 14 can include systems based on commercially available technology. In certain embodiments the feedstream(s) 11 and/or 11' to the naphtha hydrotreating zone 14 comprises full range naphtha, and the full range of hydrotreated naphtha is passed to the catalytic reforming zone 16. In other embodiments, the feedstream(s) 11 and/or 11' to the naphtha hydrotreating zone 14 comprises heavy naphtha, and hydrotreated heavy naphtha is passed to the catalytic reforming zone 16. In further embodiments, the feedstream(s) 11 and/or 11' to the naphtha hydrotreating zone 14 comprises full range naphtha, the full range of hydrotreated naphtha is passed to a separator between the naphtha hydrotreating zone 14 and the catalytic reforming zone 16, and hydrotreated heavy naphtha is passed to the catalytic reforming zone 16.

The streams 15 and/or 15' are passed to the catalytic reforming zone 16, which operates as is known to improve its quality, that is, increase its octane number to produce a reformate stream 18. In addition, the hydrogen rich gas stream 17 is produced, all or a portion of which can optionally be used to meet the hydrogen demand of the naphtha hydrotreating zone 14 (not shown). The reformate stream 18 or a portion 18*a* thereof can be used as a feedstock for the aromatic complex 19. A portion 18*b* of stream 18 can optionally be used directly as a gasoline blending pool component, for instance 0-99, 0-95, 0-90, 0-80, 0-70, 0-60, 0-50, 0-40, 0-30, 0-20 or 0-10 V %. In the aromatic complex 19, a gasoline pool stream 21 is discharged. In certain embodiments the benzene content of the gasoline pool stream 21 is less than or equal to about 3 V % or about 1 V %. In addition, aromatic products are recovered as one or more stream(s) 22.

The naphtha hydrotreating zone 14 is operated under conditions, and utilizes catalyst(s), effective for removal of a significant amount of the sulfur and other known contaminants. Accordingly, the naphtha hydrotreating zone 14 subjects feed to hydrotreating conditions to produce a hydrotreated naphtha or hydrotreated heavy naphtha stream 15 effective as feed to the catalytic reforming zone 16. The naphtha hydrotreating zone 14 operates under conditions of, for example, temperature, pressure, hydrogen partial pressure, liquid hourly space velocity (LHSV), catalyst selection/loading that are effective to remove at least enough sulfur, nitrogen, olefins and other contaminants needed to meet requisite product specifications. For example, the naphtha hydrotreating zone 14 can be operated under conditions effective to produce a naphtha range stream that meets requisite product specifications regarding sulfur and nitrogen levels, for instance, a level of ≤0.5 ppmw, as is conventionally known. Effective naphtha hydrotreating reactor catalysts include those possessing hydrotreating functionality and which generally contain one or more active metal component of metals or metal compounds (oxides or sulfides) selected from the Periodic Table of the Elements IUPAC Groups 6-10. In certain embodiments, the active metal component is selected from the group consisting of Co, Ni, Mo, and combinations thereof. The catalyst used in the naphtha hydrotreating zone 14 can include one or more catalyst selected from Co/Mo, Ni/Mo and Co/Ni/Mo. Combinations of one or more of Co/Mo, Ni/Mo and Co/Ni/Mo, can also be used. In certain embodiments, Co/Mo hydrodesulfurization catalyst is suitable. The active metal component is typically deposited or otherwise incorporated on a support, such as amorphous or crystalline alumina, silica alumina, titania, zeolites, or combinations thereof. The combinations can be composed of different particles containing a single active metal species, or particles containing multiple active species.

The hydrotreated naphtha stream is treated in the catalytic reforming zone 16 to produce reformate 18. A suitable catalytic reforming zone 16 can include systems based on commercially available technology. In certain embodiments, all, a substantial portion or a significant portion of the hydrotreated naphtha stream 15 is passed to the catalytic reforming zone 16, and any remainder can be blended in a gasoline pool. Typically, within the catalytic reforming zone 16, reactor effluent, containing hot reformate and hydrogen, is cooled and passed to a separator for recovery of a hydrogen stream and a separator bottoms stream the hydrogen is split into a portion that is compressed and recycled within the reformer reactors, and an excess hydrogen stream 17. The separator bottoms stream is passed to a stabilizer column to produce a light end stream and a reformate stream. The light end stream can be recovered and combined with one or more other similar streams obtained in the refinery. The hydrogen stream 17 can be recovered and passed to other hydrogen users within the refinery, including the naphtha hydrotreating zone 14.

In general, operating conditions for reactor(s) in the catalytic reforming zone 16 include a temperature in the range of from about 400-560 or 450-560° C.; a pressure in the range of from about 1-50 or 1-20 bars; and a liquid hourly space velocity in the range of from about 0.5-10, 0.5-4, or 0.5-2 $h^{-1}$. The reformate is sent to the gasoline pool to be blended with other gasoline components to meet the required specifications. Cyclic and CCR process designs include online catalyst regeneration or replacement, and accordingly the lower pressure ranges as indicated above are suitable. For instance, CCRs can operate in the range of about 5 bar, while semi regenerative systems operate at the higher end of the above ranges, with cyclic designs typically operating at a pressure higher than CCRs and lower than semi regenerative systems.

An effective quantity of reforming catalyst is provided. Such catalysts include mono-functional or bi-functional reforming catalysts which generally contain one or more active metal component of metals or metal compounds (oxides or sulfides) selected from the Periodic Table of the Elements IUPAC Groups 8-10. A bi-functional catalyst has both metal sites and acidic sites. In certain embodiments, the active metal component can include one or more of Pt, Re, Au, Pd, Ge, Ni, Ag, Sn, Ir or halides. The active metal component is typically deposited or otherwise incorporated on a support, such as amorphous or crystalline alumina, silica alumina, titania, zeolites, or combinations thereof. In certain embodiments, Pt or Pt-alloy active metal components that are supported on alumina, silica or silica-alumina are effective as reforming catalyst. The hydrocarbon/naphtha feed composition, the impurities present therein, and the desired products will determine such process parameters as choice of catalyst(s), process type, and the like. Types of chemical reactions can be targeted by a selection of catalysts or operating conditions known to those of ordinary skill in the art to influence both the yield and selectivity of conversion of paraffinic and naphthenic hydrocarbon precursors to particular aromatic hydrocarbon structures.

Figure 1B:
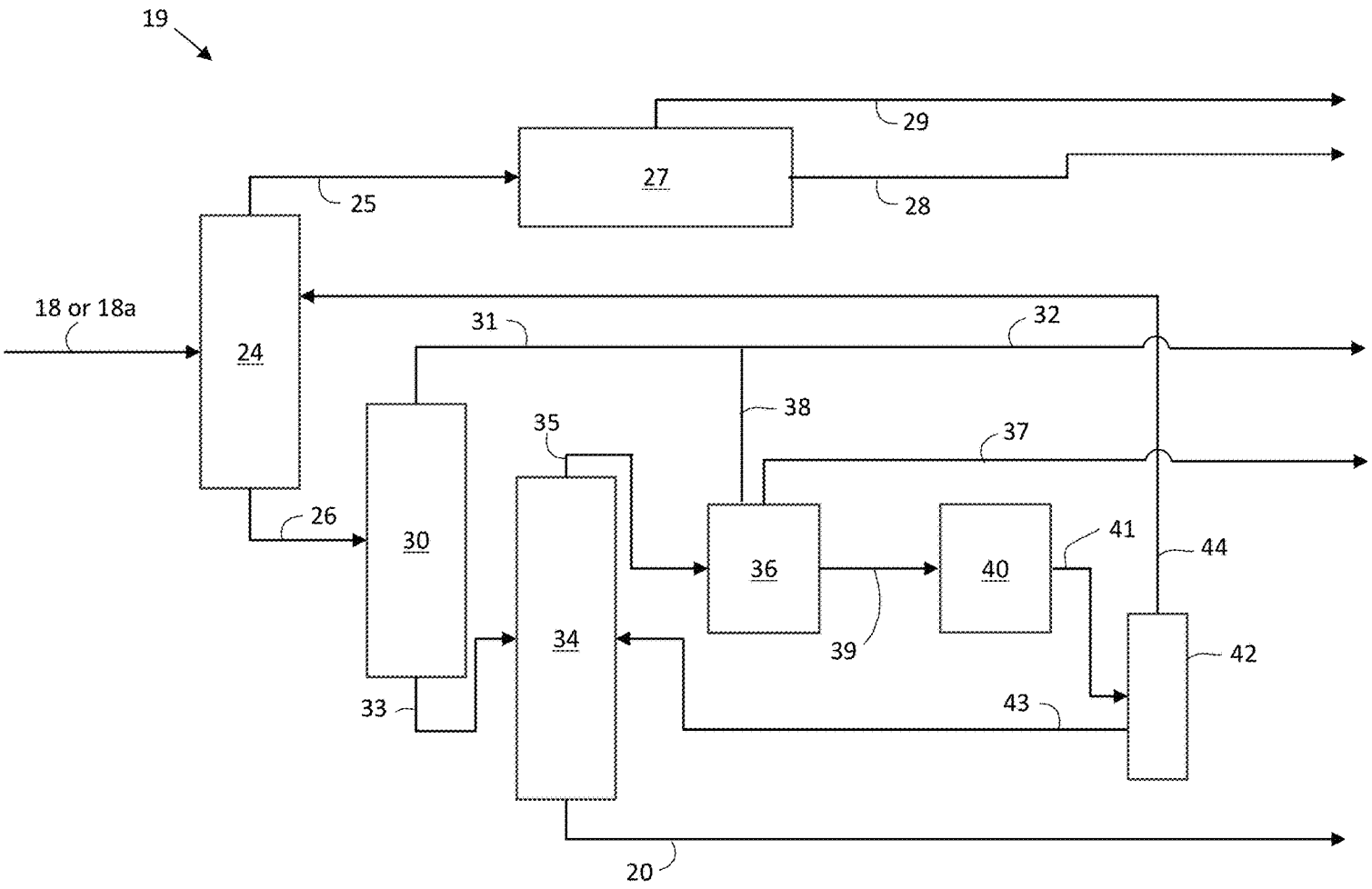
FIG. 1B (Prior Art)
FIG. 1B is a schematic process flow diagram of a conventional aromatics recovery complex.

FIG. 1B is a schematic process flow diagram of a typical aromatic complex 19. The reformate stream 18 or a portion, stream 18*a*, is passed to the aromatic complex 19 to extract and separate the aromatic products, such as benzene and mixed xylenes, which have a premium chemical value, and to produce an aromatics and benzene free gasoline blending component. The aromatic complex produces a heavier fraction of $C_9$+ aromatics, stream 20, which is not suitable as a gasoline blending component stream.

In the aromatic complex described in conjunction with FIG. 1B, toluene may be included in the gasoline cut, but other embodiments are well known in which toluene is separated and/or further processed to produce other desirable products. For instance, toluene along with $C_9$+ hydrocarbon compounds can be subjected to transalkylation to produce ethylbenzene and mixed xylenes, as disclosed in U.S. Pat. No. 6,958,425, which is incorporated herein by reference.

A reformate stream 18 or portion 18*a* from the catalytic reforming unit 16 is divided into a light reformate stream 25 and a heavy reformate stream 26 in a reformate splitter 24. The light reformate stream 25, containing $C_5/C_6$ hydrocarbons, is sent to a benzene extraction unit 27 to extract a benzene product stream 28 and to recover a gasoline component stream 29 containing non-aromatic $C_5/C_6$ compounds, raffinate motor gasoline, in certain embodiments which is substantially free of benzene. The heavy reformate stream 26, containing $C_7$+ hydrocarbons, is routed to a heavy reformate splitter 30, to recover a $C_7$ component 31 that forms part of a $C_7$ gasoline product stream 32, and a $C_8$+ hydrocarbon stream 33.

The $C_8$+ hydrocarbon stream 33 is routed to a xylene rerun unit 34, where it is separated into a $C_8$ hydrocarbon stream 35 and a heavier $C_9$+ aromatic hydrocarbon stream 20 (for instance which corresponds to the aromatic bottoms stream/$C_9$+ hydrocarbon stream 20 described in FIG. 1A). The $C_8$ hydrocarbon stream 35 is routed to a para-xylene extraction unit 36 to recover a para-xylene product stream 37. Para-xylene extraction unit 36 also produces a $C_7$ cut mogas stream 38, which can be combined with $C_7$ cut mogas stream 31 to produce the $C_7$ cut mogas stream 32. A stream 39 of other xylenes (that is, ortho- and meta-xylenes) is recovered and sent to a xylene isomerization unit 40 to produce additional para-xylene, and an isomerization effluent stream 41 is sent to a splitter column 42. A $C_8$+ hydrocarbon stream 43 is recycled back to the para-xylene extraction unit 36 from the splitter column 42 via the xylene rerun unit 34. Splitter tops, $C_7$− hydrocarbon stream 44, is recycled back to the reformate splitter 24. The heavy fraction 20 from the xylene rerun unit 34 is the aromatic bottoms stream that is conventionally recovered as process reject, corresponding to stream 20 in FIG. 1A. In certain embodiments, the streams 29 and 32 form the gasoline pool stream 21 as in FIG. 1A, and streams 28 and 37 form the aromatic products streams 22.

Figure 1C:
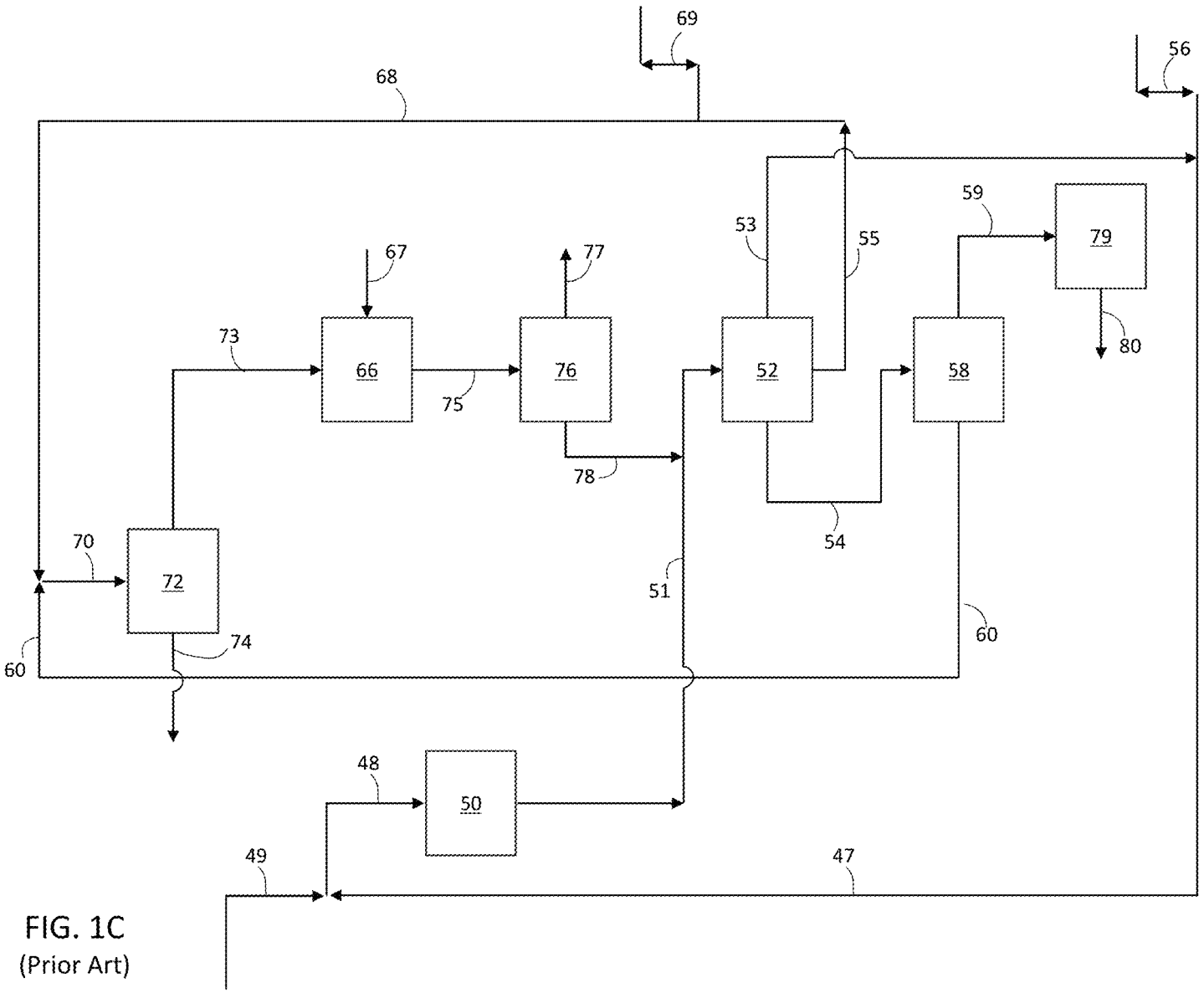
FIG. 1C (Prior Art)
FIG. 1C is a schematic process flow diagram of a conventional system for aromatic transalkylation.

FIG. 1C is a schematic process flow diagram of a transalkylation/toluene disproportionation zone for aromatic transalkylation of $C_9$+ aromatics into $C_8$ aromatics ethylbenzene and xylenes, for instance similar to that disclosed in U.S. Pat. No. 6,958,425. In general, the units of the transalkylation/toluene disproportionation zone operate under conditions and in the presence of catalyst(s) effective to disproportionate toluene and $C_9$+ aromatics. Benzene and/or toluene can be supplied from the integrated system and processed herein or externally as needed. While an example of a transalkylation/toluene disproportionation zone is show in FIG. 1C, it is understood that other processes can be used and integrated within the system and process herein for catalytic conversion of aromatic complex bottoms.

A $C_9$+ alkylaromatics feedstream 49 for transalkylation can be all or a portion of stream 20 from the aromatic complex (for instance from the xylene rerun unit). In certain embodiments the stream 49 can be a tops fraction 96 as shown and described in conjunction with FIG. 2A described herein. In additional embodiments, stream 49 can include all or a portion of products from an aromatic complex bottoms treatment zone, such as the FCC gasoline and aromatic products stream 85. In the process, a $C_9$+ alkylaromatics stream 49 is admixed with a benzene stream 47 to form a combined stream 48 as the feed to a first transalkylation reactor 50 (optionally also including an additional hydrogen stream). After contact with a suitable transalkylation catalyst such as a zeolite material, a first transalkylation effluent stream 51 is produced and passed to a first separation column 52. The separation column 52, which also receives a second transalkylation effluent stream 78, separates the combined stream into an overhead benzene stream 53; a $C_{8+}$ aromatics bottoms stream 54 including ethylbenzene and xylenes; and a side-cut toluene stream 55. The overhead benzene stream 53 is recycled back to the transalkylation reactor 50 via stream 47 after benzene is removed or added, shown as stream 56. In certain embodiments added benzene includes stream 28 from the aromatic complex in FIG. 1B. The $C_{8+}$ aromatics bottoms stream 54 is passed to a second separation column 58 from which an overhead stream 59 containing ethylbenzene and xylenes is directed to a para-xylene unit 79 to produce a para-xylene stream 80. In certain embodiments the para-xylene unit 79 can operate similar to the para-xylene extraction unit 36, the xylene isomerization unit 40, or both the para-xylene extraction unit 36, the xylene isomerization unit 40. In further embodiments the para-xylene unit 79 be the para-xylene extraction unit 36, the xylene isomerization unit 40, or both the para-xylene extraction unit 36.

A bottoms C9+ alkylaromatics stream 60 is withdrawn from the second separation column 58. The side-cut toluene stream 55 is ultimately passed to a second transalkylation unit 66 via stream 68 after toluene is added or removed, shown as stream 69. In certain embodiments added toluene includes all or a portion of the $C_7$ streams 31 or 38, or the combined stream 32, from the aromatic complex in FIG. 1B. The toluene stream 68 is admixed with the bottoms C9+ alkylaromatics stream 60 to form a combined stream 70 that enters a third separation column 72. The separation column 72 separates the combined stream 70 into a bottoms stream 74 of $C_{11}$+ alkylaromatics ("heavies"), and an overhead stream 73 of $C_9$, $C_{10}$ alkylaromatics, and lighter compounds (including $C_7$ alkylaromatics). The overhead stream 73 is directed to a second transalkylation unit 66, along with a hydrogen stream 67. After contact with a transalkylation catalyst, a second transalkylation effluent stream 75 is directed to a stabilizer column 76 from which an overhead stream 77 of light end hydrocarbons ("light-ends gas", generally comprising at least ethane) is recovered, and a bottom stream 78 of the second transalkylation product is directed to the first separation column 52. All, a major portion, a significant portion or a substantial portion of the bottoms stream 74 of $C_{11}$+ alkylaromatics can be passed to an aromatic complex bottoms treatment zone 81 shown and described in conjunction with FIGS. 2A and 2B described herein.

The bottoms fraction 20 from the aromatic complex 19 is subjected to additional processing steps, and in certain embodiments separation and processing steps, to recover additional aromatic products and/or gasoline blending material. For instance, all or a portion of the $C_9$+ heavy fraction 20 from the xylene re-run unit 34 is converted. In additional embodiments in which transalkylation is incorporated, all or a portion of a bottoms stream 74 of $C_{11}$+ alkylaromatics from the separation column 72 can be processed to recover additional aromatic products and/or gasoline blending material. While FIGS. 1A-1B, and optionally FIGS. 1A-1B in combination with FIG. 1C, show embodiments of conventional systems and processes for reforming and separation of aromatic products and gasoline products, $C_9$+ heavy fractions derived from other reforming and separation processes can be suitable as feeds in the systems and processes described herein, for instance, pyrolysis gasoline from steam cracking having condensed aromatics such as naphthalenes.

Characterizations of aromatic complex bottoms show that $C_9$+ mixtures include for example about 75-94 W % of mono-aromatics, about 4-16 W % of di, tri and tetra-aromatics, and about 2-8 W % of other components containing an aromatic ring. The two-plus ring aromatics include alkyl-bridged non-condensed di-aromatics (1), for instance 55-75, 60-70 or 65 W %, and condensed diaromatics (2) as shown below. For the $C_{11}$+ heavy fractions of aromatic complex bottoms, the mixtures include, for example, about 9-15 W % of mono-aromatics, about 68-73 W % of di, tri and tetra-aromatics, and about 12-18 W % of other components containing an aromatic ring.

(1)

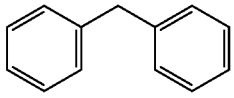

(diphenyl methane)

(2)

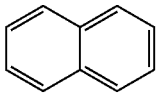

(naphthalene)

Non-condensed diaromatic rings, connected by an alkyl bridge, are commonly formed in the clay treating step prior to the pare-xylene units of the aromatic recovery complex to remove olefins and diolefins. The clay treating process utilizes a clay, which has Lewis acid sites that acts as a catalyst at temperatures of about 200° C. In the process, olefinic molecules such as alkenyl aromatics react with alkylaromatics via a Friedel-Crafts reaction to form molecules having two aromatic rings connected by an alkyl bridge as shown below, (3). In this reaction, styrene reacts with benzene to form diphenylmethane, which is a non-condensed diaromatic molecule:

(3)

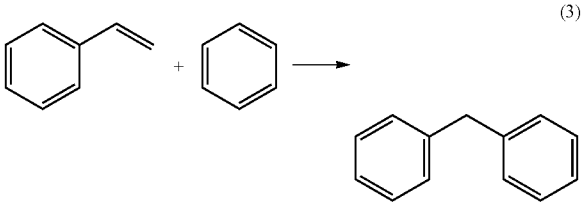

In addition to the alkylation reaction, it was reported that butyl benzene can be converted to naphthalene, a condensed diaromatic, through cyclization reactions, (4) (Kari Vahteristo Ph.D. Thesis entitled "Kinetic modeling of mechanisms of industrially important organic reactions in gas and liquid phase, University of Technology, Lappeenranta, Finland, Nov. 26, 2010).

(4)

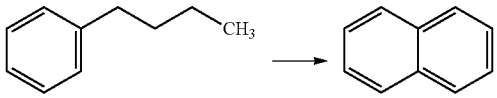

Formation of condensed diaromatics after the clay treaters was also observed. The diaromatic compounds have properties that are not suitable for gasoline blending components. For example, diphenylmethane has a density of 1.01 Kg/L, brown color (Standard Reference Method Color greater than 20), and a boiling point of 264° C. Similarly, naphthalene has a density of 1.14 Kg/L, and a boiling point of 218° C. These properties are not suitable as gasoline blending components.

In a typical refining operation, these multi-aromatics are usually separated from the unreacted alkylaromatics by fractionation, with at least one low-boiling point (or light) fraction containing reduced levels of olefins and at least one high-boiling point (or heavy) fraction containing the multi-aromatics along with high boiling point alkylaromatics. The heavy fraction containing the multi ring-aromatics may be utilized as a stream for gasoline blending because it has a relatively high octane, however the high density, color and boiling point, limit its portion of the blend to relatively low fractions. Where the heavy fraction containing the multi-aromatics is not sent for gasoline blending, it is typically utilized as fuel oil.

The heavy fraction containing the multi ring-aromatics is typically not processed in catalytic units such as a toluene/C9/C10 transalkylation unit, as associated condensed multi-aromatics in the heaviest fractions with greater than 10 carbon atoms tend to form catalyst-deactivating coke layers at the conditions used in such systems, limiting catalyst life between regenerations. Conversion of multi-aromatics into alkylaromatics retains their high octane for gasoline blending, while greatly improving the density, color and boiling point properties. Conversion of the multi-aromatics into alkylaromatics allows for their use as feedstock within BTX/BTEX petrochemicals units directly, or as feedstock to a toluene/C9/C10 transalkylation unit for the fraction of the produced alkylaromatics with carbon numbers greater than C8. Table 1 shows properties and composition of a bottoms stream obtained from an aromatic recovery complex, both where a transalkylation unit is not installed, and where a transalkylation unit is installed. When a transalkylation unit is used, the aromatic bottoms stream was found to have only 15 W % of mono-aromatics and 63 W % diaromatics.

TABLE 1

| Property | | Feedstock - Aromatic Bottoms (no TA) | Tops Gasoline - IBP - 180° C. | Bottoms Distillate - 180° C.+ | Feedstock - Aromatic Bottoms (TA) |
|---|---|---|---|---|---|
| Density | g/cc | 0.8838 | 0.8762 | 0.9181 | 0.9819 |
| Octane Number (ASTM D2799) | | — | 110 | — | — |
| Cetane Index | — | — | — | 12 | — |
| IBP | ° C. | 153 | 67 | 167 | 198 |
| 5 W % | ° C. | 162 | 73 | 176 | 207 |
| 10 W % | ° C. | 163 | 73 | 181 | 211 |
| 30 W % | ° C. | 167 | 76 | 192 | 236 |
| 50 W % | ° C. | 172 | 77 | 199 | 275 |
| 70 W % | ° C. | 176 | 79 | 209 | 303 |
| 90 W % | ° C. | 191 | 81 | 317 | 332 |
| 95 W % | ° C. | 207 | 81 | 333 | 351 |
| FBP | ° C. | 333 | 83 | 422 | 445 |
| Paraffins/napthenes | W % | 0 | — | — | 0.4 |
| Mono-aromatics | W % | 94.1 | — | — | 15.2 |
| Naphthenic mono-aromatics | W % | 0.9 | — | — | 9.4 |
| Di-aromatics | W % | 3.7 | — | — | 61.3 |
| Naphthenic di-aromatics | W % | 0.9 | — | — | 7.5 |
| Tri+ Aromatics | W % | 0.3 | — | — | 4.5 |

As noted herein, the feed 20 to an aromatic complex bottoms treatment zone 81 can be an aromatic complex bottoms stream or a heavy portion thereof. In certain embodiments the feed to the aromatic complex bottoms treatment zone 81 is undiluted by a solvent. Such feeds can include, single-ring aromatics with at least three additional carbon atoms (for example one 3 carbon alkyl group, three 1 carbon alkyl groups, one 2 carbon alkyl group and one 1 carbon alkyl group, or combinations thereof). In certain embodiments the feed 20 can include a major portion, a significant portion or a substantial portion of such single-ring aromatics with one or more alkyl groups containing three carbon atoms. In addition, the feed 20 can include alkyl bridged non-condensed alkyl multi-aromatic compounds. In certain embodiments the alkyl bridged non-condensed alkylaromatic compounds include at least two benzene rings connected by an alkyl bridge group having at least two carbons, where the benzene rings are connected to different carbons of the alkyl bridge group. In certain embodiments, the alkyl bridged non-condensed alkylaromatic compounds include additional alkyl groups connected to the benzene rings of the alkyl bridged non-condensed alkylaromatic compounds. In certain embodiments, all or a portion of the $C_9$+ heavy fraction 20 from the xylene re-run unit 34 is the feed to the aromatic complex bottoms treatment zone 81. For example, various alkyl bridged non-condensed alkylaromatic compounds may include a mixture of chemical compounds illustrated by formulas (5) (minimum carbon number of 16), (6), (7), and combinations of these compounds.

(5)

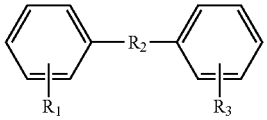

-continued (6)

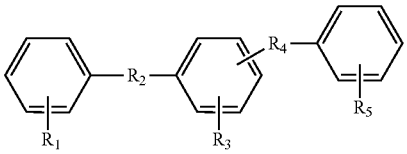

(7)

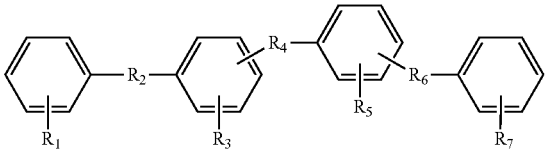

where: $R_2$, $R_4$, and $R_6$ are alkyl bridge groups independently having from two to six carbon atoms; $R_1$, $R_3$, $R_5$, and $R_7$ are independently selected from the group consisting of hydrogen and an alkyl group having from one to eight carbon atoms. In addition to the groups $R_1$, $R_3$, $R_5$, and $R_7$, the benzene groups of formulas (5), (6), and (7) may further include additional alkyl groups connected to the benzene groups, respectively. The total carbon number for non-condensed alkylaromatic compounds of the formula (5) herein is at least 16. In addition to the four benzene groups of formula (7), the various alkyl bridged non-condensed alkylaromatic compounds may include five or more benzene groups connected by alkyl bridges, where the additional benzene groups further may include alkyl groups connected to the additional benzene groups.

Figure 2A:
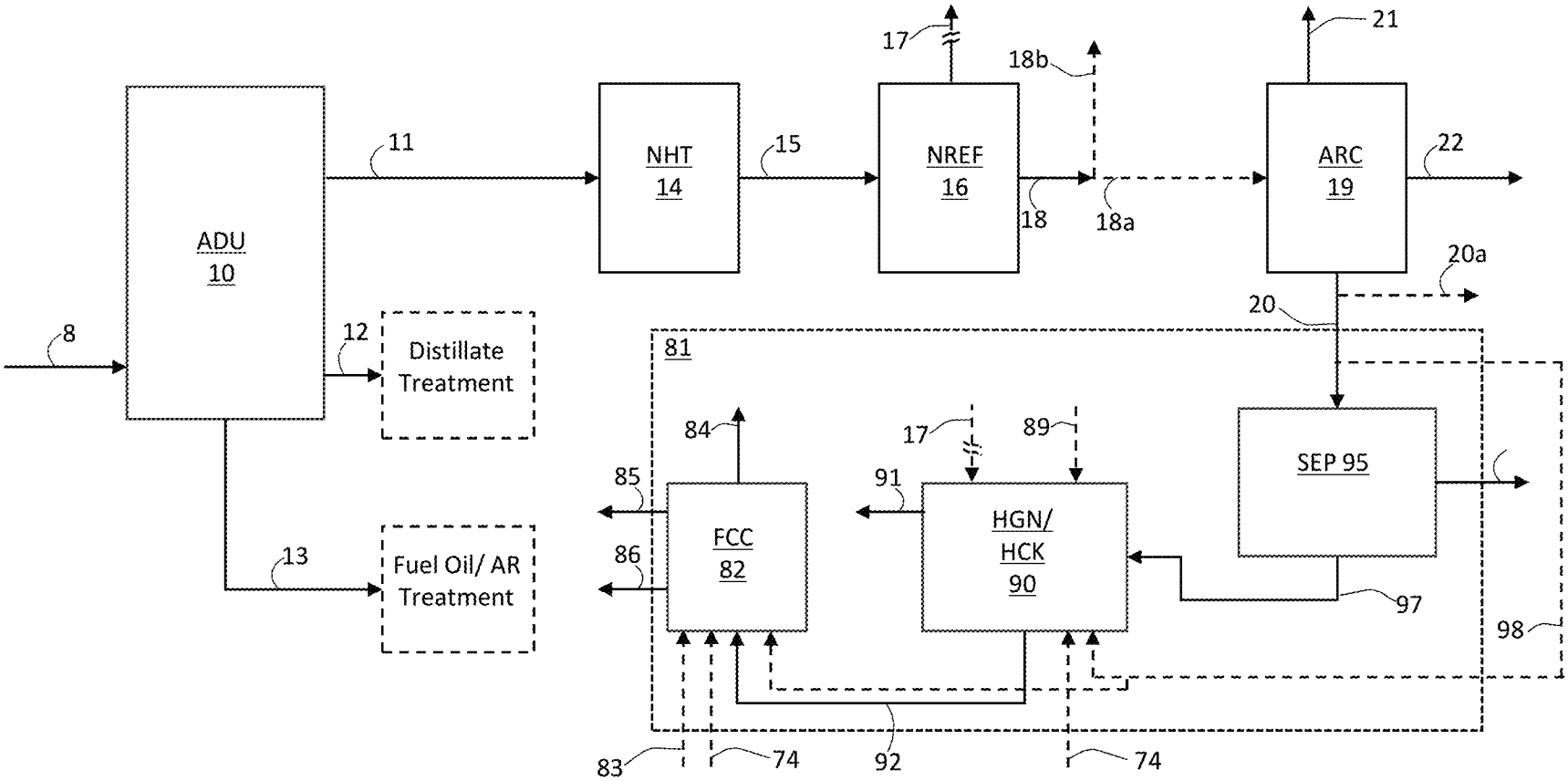
FIG. 2A is a schematic process flow diagram of an embodiment of a system in which aromatic bottoms are separated and passed to an HGN/HCK zone and an FCC unit.

FIG. 2A schematically shows units and operations similar to FIG. 1A upstream of the aromatic complex 19, using like reference numerals for like units or streams. FIG. 2A is a schematic process flow diagram of a refinery including conversion of naphtha into gasoline and aromatic products. The refinery includes units similar to those described with respect to FIG. 1A: an atmospheric distillation column 10, a naphtha hydrotreating zone 14 and a catalytic reforming zone 16. The aromatic complex 19 is also included that produces the gasoline pool stream(s) 21, the aromatic products stream(s) 22, and the aromatic complex bottoms stream 20. In certain embodiments, a portion of stream 20, shown as stream 20*a* (in dashed lines), is diverted. A separation zone 95 is provided having one or more inlets in fluid communication with the aromatic bottoms stream 20 outlet(s), one or more outlets for discharging a tops stream 96, and one or more outlets for discharging a bottoms stream 97. The separation zone 95 can include a distillation column (for example having 5 or more theoretical trays), a flash unit and/or a stripper. The aromatic complex bottoms treatment zone 81 is provided to utilize and convert a portion of the aromatic complex bottoms stream 20, bottoms stream 97, into additional fuel and/or petrochemical products or blending components.

In certain embodiments the quantity, quality and nature of the tops fraction 96 is such that it can be used as gasoline blending components without further treatment, and separation is carried out accordingly. In certain embodiments, the tops stream 96 contains hydrocarbons boiling in the naphtha/naphtha range, and the bottoms stream 97 contains hydrocarbons boiling above the naphtha range. In certain embodiments, the tops stream 96 contains $C_9$ components, and the bottoms stream 97 containing $C_{10}$+ components. In certain embodiments, the tops stream 96 contains $C_9$ and $C_{10}$ components, and the bottoms stream 97 contains $C_{11}$+ components. In certain embodiments, the tops stream 96 contains about 50-99 wt. % of the $C_9$ and $C_{10}$ compounds. In another embodiment, the tops stream 96 contains about 60-99 wt. % of the $C_9$ and $C_{10}$ compounds. In an embodiment, the tops stream 96 contains about 80-99 wt. % of the $C_9$ and $C_{10}$ compounds. In certain embodiments the tops fraction comprises naphtha range hydrocarbons and the bottoms fraction comprises diesel range hydrocarbons. In certain embodiments the tops fraction comprises one or more gasoline fractions and the bottoms fraction comprises hydrocarbons boiling above the gasoline fractions. The bottoms stream 97 is in fluid communication with the aromatic complex bottoms treatment zone 81. In optional embodiments, or on an as-needed basis, aromatic bottoms stream 20 outlet(s) can be in direct fluid communication with the aromatic complex bottoms treatment zone 81 via a slipstream 98 (shown in dashed lines).

All, a major portion, a significant portion or a substantial portion of the heavy aromatic complex $C_9$+ bottoms stream 20 from the aromatic complex containing alkylaromatics (for instance from the xylene rerun unit) is passed to the separation zone 95 for separation into the tops stream 96 containing hydrocarbons boiling in the naphtha/naphtha range and containing C9 and C10 components, and the bottoms stream 97 containing hydrocarbons boiling above the naphtha range, such as diesel range distillates, and containing $C_{11}$+ components. All, a major portion, a significant portion or a substantial portion of the bottoms stream 97 is routed to the aromatic complex bottoms treatment zone 81. In certain embodiments, or on an as-needed basis, and as shown in dashed lines, a slipstream 98 which is a portion of the aromatic complex bottoms stream 20 is routed directly to the aromatic complex bottoms treatment zone 81. For instance, portion 98 of stream 20 can be in the range of about 0-100, 0-99, 0-95, 0-90, 0-80, 0-70, 0-60, 0-50, 0-40, 0-30, 0-20 or 0-10 V %. Factors that contribute to use and/or quantity of the slipstream 98 include whether the bottoms fraction is $C_{11}$+, for instance when aromatic transalkylation is integrated, gasoline market supply and demand considerations, and the usable gasoline content of stream 20.

Figure 2B:
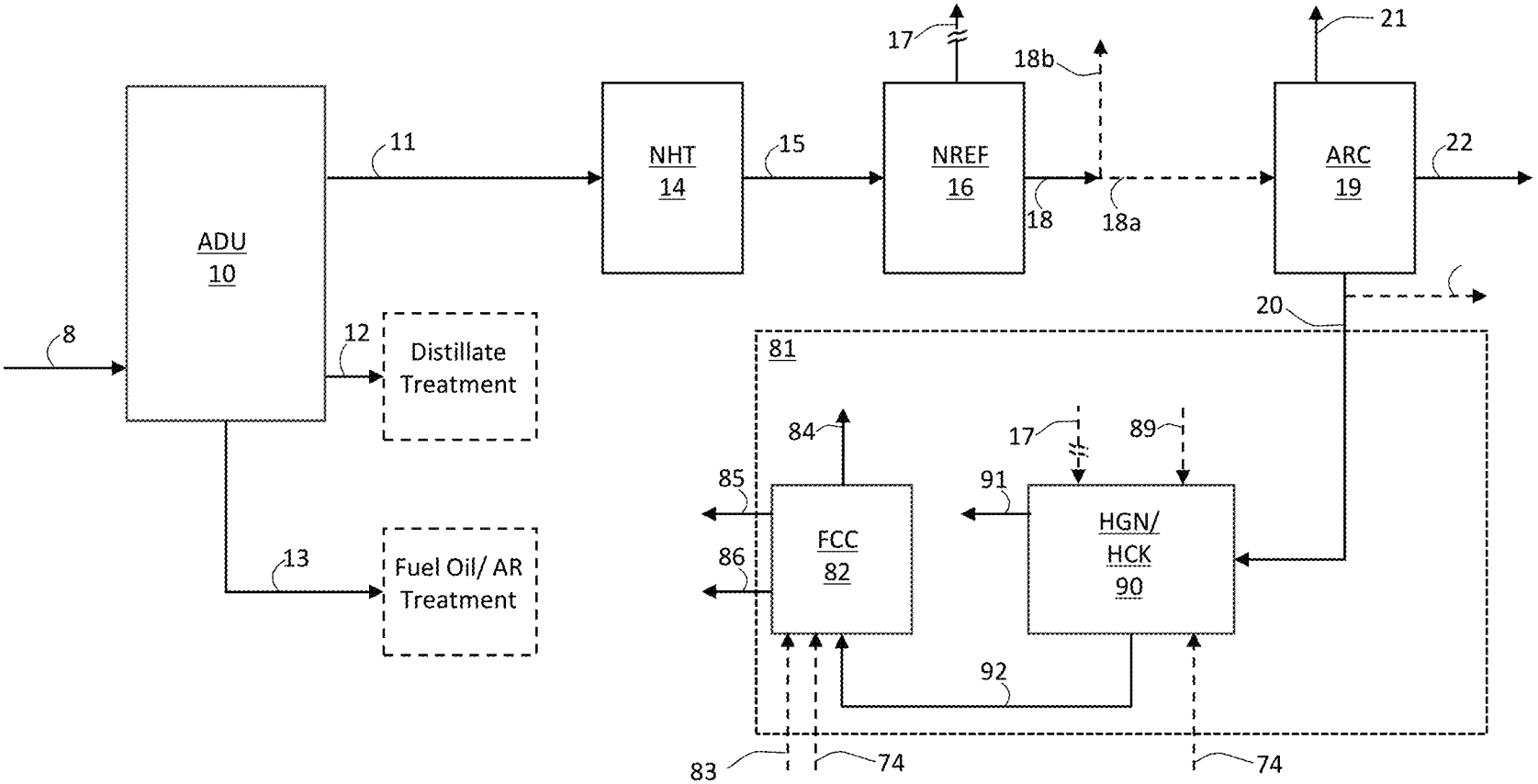
FIG. 2B is a schematic process flow diagram of an embodiment of a system in which aromatic bottoms are passed to an HGN/HCK zone and an FCC unit.

With reference to FIG. 2B, units and operations similar to FIG. 1A upstream of the aromatic complex 19 are shown, using like reference numerals for like units. FIG. 2B is a schematic process flow diagram of a refinery including conversion of naphtha into gasoline and aromatic products. The refinery includes units similar to those described with respect to FIG. 1A: an atmospheric distillation column 10, a naphtha hydrotreating zone 14 and a catalytic reforming zone 16. The aromatic complex 19 is also included that produces the gasoline pool stream(s) 21, the aromatic products stream(s) 22, and the aromatic complex bottoms stream 20. In certain embodiments, a portion of stream 20, shown as stream 20*a* (in dashed lines), is diverted. An aromatic complex bottoms treatment zone 81 is provided to utilize and convert all or a portion of the aromatic complex bottoms stream 20, into additional fuel and/or petrochemical products or blending components. In certain embodiments, all, a major portion, a significant portion or a substantial portion of the aromatic bottoms stream 20 from the aromatic complex containing $C_9$+ alkylaromatics (for instance from the xylene rerun unit) is passed directly to the aromatic complex bottoms treatment zone 81.

In certain embodiments the aromatic complex bottoms treatment zone 81 is also in fluid communication with a source of an additional feedstream 83 (as shown in both FIGS. 2A and 2B in dashed lines). For example, the additional feedstream 83 can comprise one or more feedstocks selected from the group consisting of vacuum gas oil, demetallized oil and/or hydrocracker bottoms, and atmospheric residue. These feeds can be passed to the aromatic complex bottoms treatment zone 81 directly, or in certain embodiments can be subjected to hydrotreating. In certain embodiments, for example when a transalkylation and disproportionation zone as in FIG. 1C or similar thereto is used, the aromatic complex bottoms treatment zone 81 is also in fluid communication with a heavies stream 74 (as shown in both FIGS. 2A and 2B in dashed lines).

Treating the bottoms stream from an aromatic complex includes converting single ring mono alkylaromatics to BTX/BTEX by breaking the alkyl chains, and/or converting alkyl-bridged, non-condensed multi-aromatics by breaking the bridge between the rings. In the present processes and systems, aromatic bottoms stream(s) from the aromatic complex containing $C_9$+ alkylaromatics (for instance from a xylene rerun column), typically considered relatively low-value effluents, are subjected to dual functionality or two-stage hydrodearylation (hydrogenation/low pressure hydrocracking) to both convert alkyl-bridged non-condensed alkyl multi-aromatic compounds into mono-aromatics, and to convert a portion of the aromatics into paraffins and naphthenes. The product stream is then passed to a fluidized catalytic cracking (FCC) unit to improve mono-aromatic formation with high levels of BTX/BTEX (in certain embodiments with selectivity to $C_8$) and to produce light olefin gases and FCC liquid products. The FCC liquid products can be recycled, for instance to the naphtha reforming unit or to the reformate stream, to improve gasoline volume and quality. In further embodiments FCC liquid products are referred to as a mono-naphthene product composition which can be separated into mono-aromatics and paraffins. In additional embodiments all or a portion of the FCC liquid products can be utilized as fuel oil, directed to one or more hydroprocessing units within the refinery (for instance in combination with streams 12 and/or 13 to enhance production of additional diesel, jet fuel and/or kerosene), and/or directed to a diesel or jet/kerosene pool as blending components. In certain embodiments the gasoline blending pool contribution is increased according to the process herein.

Hydrodearylation refers to a process for the cleaving of the alkyl bridge of non-condensed, alkyl-bridged multi-aromatics or heavy alkylaromatic compounds to form alkyl mono-aromatics, in the presence of a catalyst and hydrogen. For example, U.S. Pat. Nos. 10,053,401 and 10,093,873 disclose passing an aromatics bottoms stream from, for instance, a xylene rerun column of an aromatic complex, to a hydrodearylation unit, despite conventionally limited use as gasoline blending components because of its dark color, high density and high boiling point. Hydrodearylation allows for processing of this low-value stream at relatively mild conditions to yield a higher composition of mono-aromatics and a lower composition of the problematic di-aromatics.

A hydrogenation/hydrocracking (HGN/HCK) unit is in fluid communication with the aromatic complex bottoms stream, directly or with an intermediate separator, wherein the HGN/HCK unit is operable for hydrogenation and low pressure hydrocracking (for instance, less than about 60 bars) of the aromatic complex bottoms and/or diesel range hydrocarbons derived from the aromatic complex bottoms, and/or a heavy portion thereof. Liquid effluent from the hydrogenation/hydrocracking zone is directed to a fluidized catalytic cracking (FCC) unit which is operable to produce light olefins and a stream rich in BTX/BTEX.

Hydrogenation processes are known in the petroleum industry to convert aromatic rich petroleum streams into naphthenes, which have desirable fuel properties such as smoke point for jet fuel, cetane number for diesel, and the like. Hydrogenation is typically performed at moderately high hydrogen partial pressure over a non-noble metal catalyst such as Ni, Mo or a combination thereof, or for deep hydrogenation a noble metal catalyst such as Pt, Pd or a combination thereof. Noble base catalysts plus acidic catalysts such as zeolite-containing catalysts enhance the hydrogen transfer reactions during alkylaromatic dealkylation.

In the present processes and systems, aromatic bottoms stream(s) from the aromatic complex, typically considered relatively low-value effluents, are subjected to an integrated process including a hydrodearylation process including hydrogenation and low pressure hydrocracking (which can be a two-stage process in sequential reactors or catalyst beds, and/or use a mixture or a dual-catalyst system), and an FCC process to catalytically crack liquid effluents from the HGN/HCK process to produce a stream that is rich in BTX/BTEX, and light olefins. All or a portion of the FCC product(s) can be recycled back to the reforming unit as gasoline blending components to improve gasoline volume and quality. Alternatively, the mono-naphthenic product mixture that is formed can be separated into mono-aromatic and paraffin products and utilized as fuel oil, directed to one or more hydroprocessing units within the refinery (for instance in combination with streams 12 and/or 13 to enhance production of additional diesel, jet fuel and/or kerosene), and/or to directed to a diesel or jet/kerosene pool as blending components.

The aromatic complex bottoms treatment zone 81 as shown in both FIGS. 2A and 2B includes an HGN/HCK zone 90 and an FCC zone 82. In general, the series of units are operable to crack alkylaromatics for conversion into one or more additional product streams from which BTX/BTEX and/or suitable gasoline blending components, and other valuable products, are obtained. In certain embodiments, the hydrocarbon feedstock to the aromatic complex bottoms treatment zone 81 comprises all or a portion of the aromatic complex bottoms stream that is undiluted by a solvent. The conversion includes breaking the alkyl chains in single ring mono alkylaromatics to produce aromatic products, and/or hydrodearylation to break the bridge between the rings of alkyl-bridged, non-condensed multi-aromatics including any unconverted alkyl-bridged non-condensed alkyl multi-aromatic compounds from the HGN/HCK zone 90 to generate mono-aromatics and/or mono-naphthenes. The process allows for production of additional aromatic products and/or gasoline blending pool components. For example, the HGN/HCK zone 90 is operable to hydrogenate/hydrocrack the heavy aromatics stream with a (dual) catalyst and perform hydrodearylation of alkyl-bridged di-aromatics, hydrogenation of a portion of the aromatics to naphthenes, and cracking of naphthenes to paraffins. The FCC zone 82 is operable to further crack the hydrogenated/hydrocracked bottoms stream with a catalyst and produce overall products with a higher level of BTX and/or BTEX as compared to the aromatic bottoms stream.

The HGN/HCK zone 90 includes one or more reactors operable to treat all or a portion of the aromatic complex bottoms stream by hydrodearylation, including hydrogenation and low pressure hydrocracking. In general, the HGN/HCK zone 90 includes one or more outlets for discharging a gas stream 91 and one or more outlets for discharging a liquid effluent stream 92. The HGN/HCK zone 90 reactor(s) include one or more inlets in fluid communication, via a separator or directly, with the aromatic complex bottoms stream. In the embodiment of FIG. 2A the HGN/HCK zone 90 reactor(s) include one or more inlets in fluid communication with the bottoms stream 97 from the separation zone 95 and optionally the slipstream 98 obtained from the bottoms fraction(s) 20. In the embodiment of FIG. 2B the HGN/HCK zone 90 reactor(s) include one or more inlets in fluid communication with the aromatic bottoms stream 20. In additional embodiments in which transalkylation is incorporated, all or a portion of a bottoms stream 74 of $C_{11}$+ alkylaromatics from the separation column 72 is in fluid communication with the HGN/HCK zone 90. The HGN/HCK zone 90 is in fluid communication with one or more sources of hydrogen including recycled hydrogen from the HGN/HCK zone 90, a hydrogen stream 17 from the catalytic reforming zone 16, and/or a hydrogen stream 89 which can be make-up hydrogen from another source. The outlet(s) of the HGN/HCK zone 90 discharge the gas stream 91 and the liquid effluent stream 92. The gas stream 91 can include $C_1$-$C_4$ hydrocarbons (fuel gas and LPG). In certain embodiments light naphtha range hydrocarbon components, or a light fraction of heavy naphtha range hydrocarbon components (for instance, having nominal boiling points of less than about 180° C.) are also separated (via stream 91 or a separate stream), and can be passed to a light naphtha pool for use, for instance, as steam cracking feed or as isomerization feed.

The outlet(s) of the HGN/HCK zone 90 for discharging the liquid effluent stream 92 are in fluid communication with one or more inlets of the FCC zone 82. In certain embodiments (not shown), effluents from the reaction vessels are cooled in an exchanger and sent to a high pressure cold or hot separator and liquid effluents are passed to the FCC zone 82. In certain embodiments the FCC zone 82 is in fluid communication with a source of an additional feedstream 83 as indicated by dashed lines. In embodiments in which transalkylation is incorporated, the FCC zone 82 can be in fluid communication with one or more outlets of the separation column 72 discharging the bottoms stream 74 of $C_{11}$+ alkylaromatics, as indicated by dashed lines.

The FCC zone 82 is in certain embodiments an existing unit within a refinery, or in other embodiments can be a grassroots unit, for instance of a scale that is less than that of typical FCC units processing refinery VGO streams. The FCC zone 82 generally comprises reaction, catalyst regeneration and product separation zones, as is conventionally known. The FCC zone 82 includes plural outlets for discharging, for instance, a gas product stream 84 including $C_2$-$C_4$ olefins and other gases (which can be separated into multiple streams, not shown, including one with $C_2$-$C_4$ olefins, and one with other gases), an FCC gasoline and aromatic products stream, FCC naphtha, stream 85 (which can be separated into FCC gasoline and aromatic products, not shown) and a cycle oil stream 86. In certain embodiments, stream 85 includes heavier ends of light naphtha range components and lighter ends of heavy naphtha range components whereby BTX/BTEX components are included, for instance, containing hydrocarbons boiling in the range of about 50-160, 50-150, 50-140, 60-160, 60-150, 60-140, 70-160, 70-150, 70-140, 80-160, 80-150 or 80-140° C.

The feed to the HGN/HCK zone 90 contains aromatics including alkylaromatics as a major portion, a significant portion or a substantial portion of its composition. The HGN/HCK zone 90 is operable to convert its feed into the liquid effluent stream 92, which contains paraffins and naphthenes as a major portion, a significant portion or a substantial portion of the composition of stream 92. Additionally, non-condensed di-aromatic hydrocarbon compounds including alkyl-bridged non-condensed di-aromatics that are contained in the feed to the HGN/HCK zone 90 are converted by hydrodearylation into mono-aromatic hydrocarbon compounds and mono-naphthenic hydrocarbon compounds. Hydrogenation also converts aromatics to naphthenes and/or naphtheno-aromatics, with low pressure hydrocracking promoting opening of the naphthene rings to produce mono-aromatics or paraffins.

In operation of the system depicted in FIG. 2A, the HGN/HCK zone 90 receives all or a portion of the bottoms stream 97 from the separation zone 95, and in certain embodiments also the stream 98 (shown in dashed lines), derived from the aromatic bottoms stream 20. In operation of the system shown in FIG. 2B, the HGN/HCK zone 90 receives all or a portion of the aromatic bottoms 20. The aromatic bottoms 20 or the heavy portion 97 thereof (optionally in combination with a slipstream 98), and hydrogen, are charged to the reactor(s) of the HGN/HCK zone 90. In embodiments in which transalkylation is incorporated, all or a portion of a bottoms stream 74 of $C_{11}$+ alkylaromatics from the separation column 72 can be directed to the HGN/HCK zone 90. In certain embodiments the bottoms stream 74 is a major portion, a significant portion, a substantial portion feed or all of the feed to the HGN/HCK zone 90. Hydrogen is provided in an effective quantity of hydrogen to support the hydrogenation and low pressure hydrocracking of the aromatic compounds in the feed, the reaction conditions, the selected catalysts and other factors, and can be any combination including recycle hydrogen from optional gas separation subsystems (not shown) between the reaction zone and fractionating zone, catalytic reformer hydrogen stream 17, and make-up hydrogen stream 89.

The HGN/HCK reaction vessel effluent is typically passed to one or more high pressure and low pressure separation stages, for instance typically high pressure separation followed by low-pressure separation, to recover recycle hydrogen. For example, effluents from the HGN/HCK reaction vessel are cooled in an exchanger and sent to a high pressure hot and/or cold separator. Separator tops are cleaned in an amine unit and the resulting hydrogen rich gas stream is passed to a recycling compressor to be used as a recycle gas in the reaction vessel. Separator bottoms from the high pressure separator, which are in a substantially liquid phase, are cooled and then introduced to a low pressure cold separator. Remaining gases including hydrogen and any light hydrocarbons, which can include $C_1$-$C_4$ hydrocarbons, can be conventionally purged from the low pressure cold separator and sent for further processing, for instance as all or a part of stream 91. The liquid stream from the low pressure cold separator is stream 92 that is passed to the FCC zone 82.

The HGN/HCK zone 90 includes an effective reactor configuration with the requisite reaction vessel(s), feed heaters, heat exchangers, hot and/or cold separators, product fractionators, strippers, and/or other units to process the feedstream derived from the aromatic complex bottoms. The HGN/HCK zone generally contains one or more fixed-bed, ebullated-bed, slurry-bed, moving bed, continuous stirred tank (CSTR) or tubular reactors, in series or parallel arrangement, which is/are generally operated in the presence of hydrogen under conditions, and utilizes catalyst(s), effective for hydrogenation and mild hydrocracking of the aromatic complex bottoms or the heavy portion thereof. Additional equipment, including exchangers, furnaces, feed pumps, quench pumps, and compressors to feed the reactor(s) and maintain proper operating conditions, are well known and are considered part of the HGN/HCK zone 90. In addition, equipment including pumps, compressors, high temperature separation vessels, low temperature separation vessels and the like to separate reaction products and provide hydrogen recycle within the HGN/HCK zone 90, are well known and are considered part of the HGN/HCK zone 90.

The HGN/HCK zone 90 generally includes a reaction vessel having multiple layers or beds of different functional catalysts (optionally including inter-bed quench gas), multiple reaction vessels of different functional catalysts or a mixture of different functional catalysts in a reaction vessel. In embodiments including a reaction vessel having multiple layers or beds of different functional catalysts, or multiple reaction vessels of different functional catalysts, the feed is hydrogenated and the resulting compounds are subjected to low pressure hydrocracking. In embodiments including a mixture of different functional catalysts in a reaction vessel, the feed is subjected to hydrogenation and low pressure hydrocracking.

In certain embodiments, the HGN/HCK zone 90 is operable to favor formation of mono-aromatics and/or mono-naphthenes. In further embodiments the HGN/HCK zone 90 is operable to favor formation of naphthenes and/or naphtheno-aromatics and/or paraffins. Higher temperature and/or pressure conditions increase conversion of aromatics to naphthenes and paraffins.

In certain embodiments, the HGN/HCK zone 90 operating conditions include:

a reactor temperature (° C.) in the range of from about 150-450, 200-450, 300-450, 350-450, 150-435, 200-435, 300-435, 350-435, 150-400, 200-400, 200-400 or 300-400;

a hydrogen partial pressure (bars) in the range of from about 1-100, 15-100, 30-100, 1-70, 15-70, 30-70, 1-60, 15-60 or 30-60;

a hydrogen gas feed rate (standard liters per liter of hydrocarbon feed, SLt/Lt) up to about 1000, 500, 300 or 100, in certain embodiments from about 1-1000, 100-1000, 1-500, 100-500, 1-300, 100-500 or 1-100; and a liquid hourly space velocity ($h^{-1}$), on a fresh feed basis relative to the catalysts, in the range of from about 0.5-10.0, 0.5-6.0, 0.5-5.0, 0.5-4.0, 0.5-2.0, 0.8-10.0, 0.8-6.0, 0.8-5.0, 0.8-4.0 or 0.8-2.0.

Suitable dual-catalyst systems effective for the HGN/HCK zone 90 include multiple layers or beds of different functional catalysts in a reaction vessel, multiple reaction vessels in series having different functional catalysts or a mixture of different functional catalysts in a reaction vessel. In embodiments in which different functional catalysts are used, they include: a first functional catalyst effective for hydrogenation of aromatics to naphthenes/naphtheno-aromatics, and hydrodearylation; and a second functional catalyst for light hydrocracking to perform ring opening of the naphthenes to paraffins and naphtheno-aromatics to aromatics, and hydrodearylation. The first functional catalyst can include solid acid catalysts such as a noble metal on a support effective for hydrogenation, for example a Pt-containing hydrogenation catalyst with some zeolite. The second functional catalyst can include solid acid hydrocracking catalysts such as an active metal on a support effective for hydrocracking. For example, suitable solid acid catalysts are Lewis acids, Brønsted acids or a mixture thereof.

A first functional catalyst of the dual-catalyst system used in the HGN/HCK zone 90 (in the same reactor or bed as the second functional catalyst, or in a different reactor or bed as the second functional catalyst) can be one or more conventionally known, commercially available or future developed hydrogenation catalysts effective to maximize hydrogen transfer and to hydrogenate aromatics. The selection, activity and form of the first functional catalyst can be determined based on factors including, but not limited to operating conditions, selected reactor configuration, feedstock composition, catalyst composition and desired degree of conversion. In certain embodiments if the delta temperature in a bed is greater than or equal to about 25° C., additional beds can be used with interbed hydrogen injection.

Suitable first functional catalysts contain one or more active components of metals or metal compounds (oxides, carbides or sulfides) selected from the Periodic Table of the Elements IUPAC Groups 7, 8, 9 and/or 10. In certain embodiments the active component of the first functional catalyst is selected from the group consisting of Pt, Pd, Ti, Rh, Re, Ir, Ru, and Ni, and combinations thereof. In certain embodiments the active components of the first functional catalyst include a noble metal selected from the group consisting of Pt, Pd, Rh, Re, Ir and Ru, and combinations thereof. In certain embodiments the active components of the first functional catalyst include a noble metal selected from the group consisting of Pt, Pd, and combinations thereof. In certain embodiments two or more of the active components mentioned above are used in the first functional catalyst.

The active component(s) of the first functional catalysts are typically deposited or otherwise incorporated on a support such as amorphous or crystalline alumina, γ-alumina, silica-alumina, titania or a combination thereof. In certain embodiments non-acidic amorphous alumina is effective. In certain embodiments the support of the first functional catalyst contains about 0.1-80, 0.1-30, 0.1-20, 0.1-15, 0.1-10, 0.5-80, 0.5-30, 0.5-20, 0.5-15, 0.5-10, 1-80, 1-30, 1-20, 1-15, 1-10, 2.5-80, 2.5-30, 2.5-20, 2.5-15, or 2.5-10 W %, of zeolite. The zeolite can be a suitable form of zeolite, including but not limited to one or more of (USY), (*BEA), (FAU), (MFI), (MOR), (MTW) or (MWW) zeolite framework topologies, or another effective form. In certain embodiments non-acidic catalysts are selected as the first functional catalysts so as to favor hydrogenation reactions over hydrocracking reactions. In certain embodiments a relatively small amount of acidic support material is used such as a zeolite. Particularly effective first functional catalysts to promote hydrogenation reactions include noble metal active catalyst components on non-acidic supports, such as Pt, Pd or combinations thereof on non-acidic supports. In certain embodiments suitable first functional catalysts include USY zeolite supports or another effective form, having Pt and/or Pd as the active component.

Combinations of active components of the first functional catalyst can be composed of different particles/granules containing a single active metal species, or particles containing multiple active components. The active components of the first functional catalyst can be provided in the range of about (W % based on the mass of the active component(s) relative to the total mass of the catalyst) 0.01-2, 0.05-2, 0.1-2, 0.1-1 or 0.1-0.5. In certain embodiments, the particles of the first functional catalyst have a pore volume in the range of about (cc/gm) 0.15-1.70, 0.15-1.50, 0.30-1.50 or 0.30-1.70; a specific surface area in the range of about ($m^2/g$) 100-450, 100-350, 100-300, 150-450, 150-350, 150-300, 200-450, 200-350 or 200-300; and an average pore diameter of at least about 10, 50, 100, 200, 500 or 1000 angstrom units.

In certain embodiments, suitable first functional catalysts generally include solid acid catalysts. For example, suitable solid acid catalysts are Lewis acids, Brønsted acids or a mixture thereof. In certain embodiments, the catalyst and/or the catalyst support of the first functional catalysts is prepared in accordance with U.S. Pat. Nos. 9,221,036 and 10,081,009 (jointly owned by the owner of the present application, and subject to a joint research agreement), which are incorporated herein by reference in their entireties, includes a modified USY zeolite support having one or more of Ti, Zr and/or Hf substituting the aluminum atoms constituting the zeolite framework thereof. For instance, the first functional catalysts can include an active component carried on a support containing an ultra-stable Y-type zeolite, wherein the above ultra-stable Y-type zeolite is a framework-substituted zeolite (referred to as a framework-substituted zeolite) in which a part of aluminum atoms constituting a zeolite framework thereof is substituted with 0.1-5 mass % zirconium atoms and 0.1-5 mass % titanium ions calculated on an oxide basis.

A second functional catalyst of the dual-catalyst system used in the HGN/HCK zone 90 (in the same reactor or bed as the first functional catalyst, or in a different reactor or bed as the first functional catalyst) can be one or more conventionally known, commercially available or future developed hydrocracking catalysts effective to maximize ring opening of naphthenes to form paraffins, ring opening of naphthenoaromatics to form aromatics, and to perform hydrodearylation. The selection, activity and form of the second functional catalyst can be determined based on factors including, but not limited to operating conditions, selected reactor configuration, catalyst composition, feedstock composition, and desired degree of conversion.

Suitable second functional catalysts contain one or more active components of metals or metal compounds (oxides carbides or sulfides) selected from the Periodic Table of the Elements IUPAC Groups 6, 7, 8, 9 and 10. In certain embodiments, the active component of the second functional catalyst is selected from the group consisting of Co, Ni, W, Mo, and combinations thereof. In certain embodiments the second functional catalyst is selected from the group consisting of Co/Mo, Ni/Mo, Ni/W, Co/Ni/Mo and combinations thereof. Combinations of one or more of Co/Mo, Ni/Mo, Ni/W and Co/Ni/Mo, can also be used, for instance, in plural beds or separate reactors in series.

The active component(s) of the second functional catalysts are typically deposited or otherwise incorporated on a support, which can be amorphous or crystalline, such as alumina, silica alumina, silica, titania, titania-silica or titania-silicates. In certain embodiments the second functional catalyst contains about 0.1-80, 0.1-30, 0.1-20, 0.1-15, 0.1-10, 0.5-80, 0.5-30, 0.5-20, 0.5-15, 0.5-10, 1-80, 1-30, 1-20, 1-15, 1-10, 2.5-80, 2.5-30, 2.5-20, 2.5-15, or 2.5-10 W %, of zeolite. The zeolite can be a suitable form of zeolite, including but not limited to one or more of (USY), (*BEA), (FAU), (MFI), (MOR), (MTW) or (MWW) zeolite framework topologies, or another effective form.

Combinations of active components of the second functional catalyst can be composed of different particles/granules containing a single active metal species, or particles containing multiple active components. The active components of the second functional catalyst can be provided in the range of about (W % based on the mass of the active component(s) relative to the total mass of the catalysts) 1-40, 1-30, 1-10, 1-5, 2-40, 2-30, 2-10, 3-40, 3-30 or 3-10. In certain embodiments, the catalyst particles of the second functional catalyst have a pore volume in the range of about (cc/gm) 0.15-1.70, 0.15-1.50, 0.30-1.50 or 0.30-1.70; a specific surface area in the range of about ($m^2/g$) 100-450, 100-350, 100-300, 150-450, 150-350, 150-300, 200-450, 200-350 or 200-300; and an average pore diameter of at least about 10, 50, 100, 200, 500 or 1000 angstrom units.

In certain embodiments, suitable second functional catalysts generally include solid acid catalysts. For example, suitable solid acid catalysts are Lewis acids, Brønsted acids or a mixture thereof. In certain embodiments, the catalyst and/or the catalyst support of the second functional catalysts is prepared in accordance with U.S. Pat. Nos. 9,221,036 and 10,081,009 (jointly owned by the owner of the present application, and subject to a joint research agreement), which are incorporated herein by reference in their entireties, includes a modified USY zeolite support having one or more of Ti, Zr and/or Hf substituting the aluminum atoms constituting the zeolite framework thereof. For instance, the second functional catalysts can include an active component carried on a support containing an ultra-stable Y-type zeolite, wherein the above ultra-stable Y-type zeolite is a framework-substituted zeolite (referred to as a framework-substituted zeolite) in which a part of aluminum atoms constituting a zeolite framework thereof is substituted with 0.1-5 mass % zirconium atoms and 0.1-5 mass % titanium ions calculated on an oxide basis.

In certain embodiments, the hydrogen stream to the HGN/HCK zone 90 (a single reactor with one bed, a single reactor with multiple layers or beds, or multiple reactors) includes a combination of a recycled hydrogen stream and a makeup hydrogen stream. The hydrogen stream can contain at least 70, 80 or 90 mol % hydrogen by weight. In various embodiments, the recycled hydrogen stream may be a stream from processing of a hydrocarbon product from the reactor. In various embodiments, the recycled hydrogen stream may be combined with the feedstock stream to form a combined feedstock stream that is fed to the reactor. In various embodiments, the hydrogen stream may be combined with the combined feed stream to form a second combined stream that is fed to the reactor. In various embodiments, the recycled hydrogen stream, the make-up hydrogen stream, and the feedstock stream may be combined in any order to form a combined stream that is fed to the reactor. In various embodiments, the recycled hydrogen stream, the make-up hydrogen stream, and the feedstock stream may be fed separately to the reactor or two of the streams may be combined and the other fed separately to the reactor. In various embodiments, the hydrogen stream has a portion of the stream fed directly to one or more catalyst beds of the reactor.

The catalyst (HGN and/or HCK catalysts) may be provided as one or more catalyst bed(s) in the reactor. In certain embodiments, a portion of the hydrogen stream is fed to the catalyst bed(s) of the reactor to quench the catalyst bed. The catalyst bed(s) may include two, three or more catalyst beds.

In certain embodiments, the feedstock (either whole or fractionated) to the HGN/HCK zone 90 (a single reactor with one bed, a single reactor with multiple layers or beds, or multiple reactors) is mixed with an excess of hydrogen gas in a mixing zone. A portion of the hydrogen gas is mixed with the feedstock to produce a hydrogen-enriched liquid hydrocarbon feedstock. This hydrogen-enriched liquid hydrocarbon feedstock and undissolved hydrogen can be supplied to a flashing zone in which at least a portion of undissolved hydrogen is flashed, and the hydrogen is recovered and recycled. The hydrogen-enriched liquid hydrocarbon feedstock from the flashing zone is supplied as a feed stream to the HGN/HCK zone 90. The HGN/HCK liquid product stream that is recovered from the HGN/HCK zone 90 is further processed and/or recovered as provided here.

The FCC zone 82 operates to crack naphthenic and paraffinic bonds of hydrocarbons in the HGN/HCK effluent stream 92 and optionally other feeds, typically not converting double bonds in aromatic rings, to produce an additional product stream 85, from which BTX/BTEX and gasoline blending components can be separated into one or more streams. Light gases $C_1$-$C_4$ paraffins and light $C_2$-$C_4$ olefins are also recovered, as stream 84 (which can be multiple product streams). Cycle oils are also recovered, as stream 86, which can be separated into light and heavy cycle oil, and can be utilized as fuel oil and/or directed to one or more hydroprocessing units within the refinery (for instance in combination with streams 12 and/or 13) for example, to enhance production of additional diesel and/or jet fuel.

In certain embodiments, the FCC zone 82 is operated under conditions and using catalyst to favor production of single ring aromatics with alkyl groups containing one or two carbon atoms, including toluene, xylenes and/or ethylbenzene, and light olefins. In certain embodiments, single ring aromatics with alkyl groups containing two carbon atoms comprise 5-40, 10-40, 15-40, 5-30, 10-30, 15-30, 5-20, or 10-20 W % of the FCC product based on the FCC fresh feed mass. In certain embodiments, the FCC zone 82 can be operated as a conventional FCC unit tailored to produce gasoline as a main product and light gases and cycle oils as secondary products, or at higher severities, for instance higher temperatures.

As depicted in FIGS. 2A and 2B, the FCC zone 82 receives all or a portion of the liquid effluent stream 92 from the HGN/HCK zone 90. In certain embodiments (not shown) a portion of the liquid effluent stream 92 can be discharged for use elsewhere, for instance recycled to the reforming zone and/or naphtha hydrotreater to improve gasoline volume and quality. In certain embodiments, a slipstream (not shown) comprising a portion of the bottoms stream 97 from the separation zone 95 (which in certain embodiments can include a stream 98 as noted above) in the embodiment of FIG. 2A, or a slipstream (not shown) comprising a portion of the aromatic bottoms stream 20 in the embodiment of FIG. 2A, is passed to the FCC zone 82. In certain embodiments 5-100, 5-95, 5-90, 10-100, 10-95, 10-90, 50-100, 50-95 or 50-90 wt % of stream 97 or stream 20 is passed to HGN/HCK 90, with any remainder discharged from the process for use elsewhere. For example, the remainder of stream 20 can be reacted in a hydrodearylation unit; separated in to tops fraction and a bottoms fraction, with the tops (C9 and C10) reacted in a transalkylation unit and/or used as a gasoline blending component (IBP-180° C. fraction), and with the bottoms fraction (C11+ or 180+° C. fraction) passed to the crude distillation tower, used as a diesel blending component, reacted in a hydrodearylation unit, and/or reacted in an FCC unit.

In certain embodiments (as shown in both FIGS. 2A and 2B in dashed lines) the FCC zone 82 also receives an additional feedstream 83. For example, an additional feedstream 83 can comprise one or more known FCC feedstocks selected from the group consisting of vacuum gas oil, demetallized oil and/or hydrocracker bottoms in typical FCC units, and atmospheric residue in residue FCC units. In certain embodiments, a heavy feedstream such as vacuum gas oil is added to increase coke on the FCC catalyst if necessary. In additional embodiments in which transalkylation is incorporated, all or a portion of a bottoms stream 74 of $C_{11}$+ alkylaromatics from the separation column 72 can be directed to the FCC zone 82. These feeds can be passed to the FCC zone 82 directly, or in certain embodiments can be subjected to hydrotreating and/or hydrocracking to increase FCC cracking performance.

The FCC zone 82 generally produces FCC naphtha, cycle oil, light olefins and other gases. Separated effluents include the gas product stream 84 representing $C_2$-$C_4$ olefins and other gases, the product stream 85 (for instance FCC naphtha which can be separated into FCC gasoline and aromatics), and the cycle oil stream 86 which includes light and heavy cycle oil. In addition, the product stream 85 can be further separated, for instance, into an FCC gasoline stream and an aromatics stream, for instance, with an aromatics separation section within the FCC zone 82. In certain embodiments, all or any portion of the product stream 85 is routed to the aromatic complex 19 for separation into gasoline and aromatic products. In embodiments in which an FCC gasoline is separated from the product stream 85, the benzene content of the FCC gasoline is less than or equal to about 3 V % or about 1 V %. In certain embodiments, all, a major portion, a significant portion or a substantial portion of product stream 85 is directed to the hydrotreating zone 14 and/or the catalytic reforming zone 16. In certain embodiments, all, a major portion, a significant portion or a substantial portion of product stream 85 is directed to the reformate splitter 24 and/or to a heavy reformate splitter 30 as shown in FIG. 1B. In certain embodiments the product stream 85 is rich in naphthenes, paraffins and mono-aromatics, and all or a portion can be recycled back to the catalytic reforming zone 16 for dehydrogenation of dealkylated rings to produce additional BTX/BTEX and gasoline blending components.

The FCC zone 82 includes, as is typical, a regeneration section in which cracking catalysts that have become coked, and hence access to the active catalytic sites becomes limited or nonexistent, are subjected to high temperatures and a source of oxygen to combust the accumulated coke and steam to strip heavy oil adsorbed on the spent catalyst. While arrangements of certain FCC units are described herein with respect to FIGS. 3 and 4, one of ordinary skill in the art will appreciate that other well-known FCC units can be employed.

In certain embodiments, the primary feed to the FCC zone 82 is derived from stream 83, and wherein the effluent stream 92 derived from hydrogenation/light hydrotreating of aromatic complex bottoms 20 and/or the heavy portion 97, and/or the heavies 74 comprises a minor portion of the total FCC unit feed. In other embodiments, the FCC zone 82 is designed to treat the effluent stream 92 and/or the heavies 74 which form a major portion, a significant portion or a substantial portion of the total feed to the FCC zone 82, and accordingly in such embodiments any additional feed 83 is considered secondary. In further embodiments, the system is closed so that the feed to the FCC zone 82 consists of or consists essentially of the effluent stream 92 and/or the heavies 74, for instance, as a dedicated grassroots unit. In certain embodiments, use of the slipstream 98 containing the lighter $C_9$+ components could compensate for excess coking in the FCC catalyst regeneration step.

FCC processes typically are used to catalytically crack the petroleum derived hydrocarbons boiling in vacuum gas oil range, with an acidic catalyst maintained in a fluidized state, which is regenerated on a continuous basis. The main product from such processes has conventionally been gasoline. Other products are also produced in smaller quantities via FCC processes such as light hydrocarbons gases, $C_1$-$C_4$, unconverted cycle oils and coke deposited on the catalyst is burned off at high temperatures and in the presence of air prior to recycling regenerated catalyst back to the reaction zone.

Figure 3A:
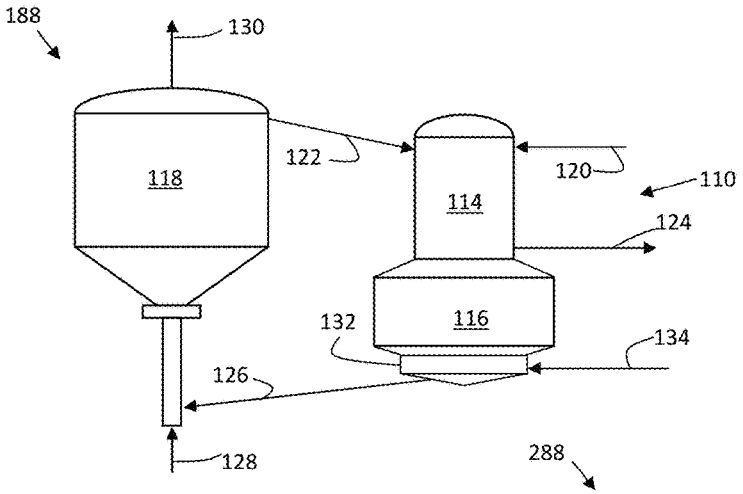
FIG. 3A is a generalized diagram of a downflow fluidized catalytic cracking reactor system that can be integrated in the systems of FIGS. 2A and 2B.

With reference to FIG. 3A, a generalized process flow diagram is provided of an FCC zone 188 which includes a downflow reactor and can be used in the system and process according to the present disclosure. The FCC zone 188 includes a reactor/separator 110 having a reaction zone 114 and a separation zone 116. The FCC zone 188 also includes a regeneration zone 118 for regenerating spent catalyst. The FCC zone 188 can be operated under conditions tailored to produce FCC gasoline, cycle oil and olefin by-products, or under conditions tailored to promote formation of olefins and that minimizes olefin-consuming reactions, such as hydrogen-transfer reactions.

A charge 120 corresponding to the FCC feed(s) disclosed with respect to FIGS. 2A and 2B is directed to the FCC zone 188. For instance, the feed can be the liquid effluent stream 92 from the HGN/HCK zone 90, optionally in combination with a slipstream obtained from the stream 97, optionally in combination with another feed 83, and/or optionally in combination with heavies 74 in embodiments in which transalkylation is used, as shown and described with respect to FIG. 2A. Alternatively, the liquid effluent stream 92 from the HGN/HCK zone 90, optionally in combination with a slipstream obtained from the stream 20, optionally in combination with another feed 83, and/or optionally in combination with heavies 74 in embodiments in which transalkylation is used, as shown and described with respect to FIG. 2B. The charge 120 is introduced to the reaction zone, in certain embodiments also accompanied by steam or other suitable gas for atomization of the feed. In addition, an effective quantity of heated fresh solid cracking catalyst particles (not shown) or hot regenerated solid cracking catalyst particles from regeneration zone 118 is also transferred, for instance, through a downwardly directed conduit or pipe 122, commonly referred to as a transfer line or standpipe, to a withdrawal well or hopper at the top of reaction zone 114. Hot catalyst flow is typically allowed to stabilize in order to be uniformly directed into the mix zone or feed injection portion of reaction zone 114.

The charge 120 is injected into a mixing zone through feed injection nozzles typically situated proximate to the point of introduction of the regenerated catalyst into reaction zone 114. These multiple injection nozzles result in the catalyst and oil mixing thoroughly and uniformly. Once the charge contacts the hot catalyst, cracking reactions occur. The reaction vapor of hydrocarbon cracked products, unreacted feed and catalyst mixture quickly flows through the remainder of reaction zone 114 and into a rapid separation zone 116 at the bottom portion of reactor/separator 110. Cracked and uncracked hydrocarbons are directed through a conduit or pipe 124 to a conventional product recovery section known in the art.

If necessary for temperature control, a quench injection can be provided near the bottom of reaction zone 114 immediately before the separation zone 116. This quench injection quickly reduces or stops the cracking reactions and can be utilized for controlling cracking severity and allows for added process flexibility.

The reaction temperature or the outlet temperature of the downflow reactor, can be controlled by opening and closing a catalyst slide valve that controls the flow of regenerated catalyst from regeneration zone 118 into the top of reaction zone 114. The heat required for the endothermic cracking reaction is supplied by the regenerated catalyst. By changing the flow rate of the hot regenerated catalyst, the operating severity or cracking conditions can be controlled to produce the desired yields of light olefinic hydrocarbons and gasoline.

A stripper 132 is also provided for separating oil from the catalyst, which is transferred to regeneration zone 118. The catalyst from separation zone 116 flows to the lower section of the stripper 132 that includes a catalyst stripping section into which a suitable stripping gas, such as steam, is introduced through line 134. The stripping section is typically provided with several baffles or structured packing over which the downwardly flowing catalyst passes countercurrently to the flowing stripping gas. The upwardly flowing stripping gas, which is typically steam, is used to "strip" or remove any additional hydrocarbons that remain in the catalyst pores or between catalyst particles.

The stripped or spent catalyst is transported through a conduit 126 to the regeneration zone 118, with lift forces from the stream 128 of oxygen-containing gas, such as pure oxygen or air, through a lift riser of the regeneration zone 118. This spent catalyst, which can also be contacted with additional combustion air, undergoes controlled combustion of any accumulated coke. Flue gases are removed from the regenerator via conduit 130. In the regenerator, the heat produced from the combustion of the by-product coke is transferred to the catalyst raising the temperature required to provide heat for the endothermic cracking reaction in the reaction zone 114. The regenerated and make-up catalyst as needed are transferred through the conduit 122.

In general, the operating conditions for the reactor of a suitable downflow FCC unit include:

reaction temperature (° C.) of about 450-680, 480-680, 510-680, 550-680, 580-680, 590-680, 450-650, 480-650, 510-650, 550-650, 580-650, 590-650, 450-630, 550-630, 580-630, 590-630, 450-620, 550-620, 580-620 or 590-620;

reaction pressure (bars) of about 1-20, 1-10 or 1-3;

contact time (seconds, in the reactor) of about 0.1-30, 0.2-30, 0.1-10, 0.2-10, 0.1-5, 0.2-5, 0.1-0.7 or 0.2-0.7; and a catalyst to feed ratio (on a mass basis) of about 1:1-40:1, 3:1-40:1, 8:1-40:1, 1:1-30:1, 3:1-30:1, 8:1-30:1, 1:1-20:1, 3:1-20:1, 8:1-20:1, 1:1-15:1, 3:1-15:1, 8:1-15:1, 1:1-10:1, 3:1-10:1.

Figure 3B:
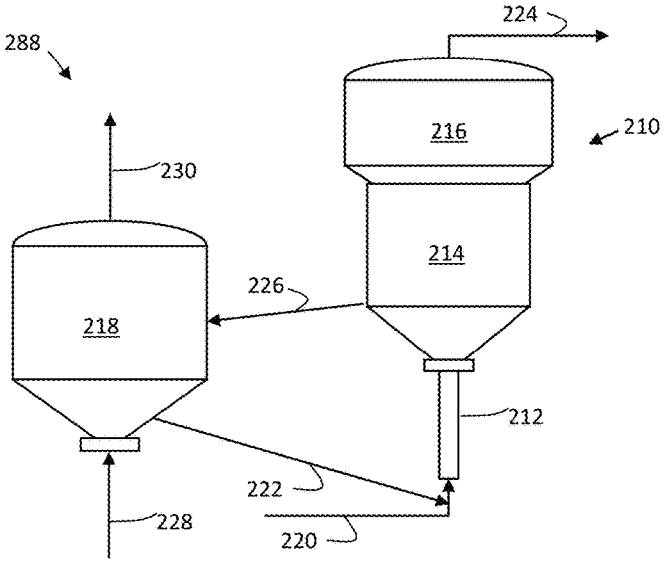
FIG. 3B is a generalized diagram of a riser fluidized catalytic cracking reactor system that can be integrated in the systems of FIGS. 2A and 2B.

In certain embodiments, an FCC unit configured with a riser reactor is provided, which can be operated under conditions tailored to produce FCC gasoline, cycle oil and olefin by-products, or under conditions tailored to promote formation of olefins and that minimizes olefin-consuming reactions, such as hydrogen-transfer reactions. FIG. 3B is a generalized process flow diagram of an FCC zone 288 which includes a riser reactor and can be used in the system and process according to the present disclosure. FCC zone 288 includes a reactor/separator 210 having a riser portion 212, a reaction zone 214 and a separation zone 216. FCC zone 288 also includes a regeneration vessel 218 for regenerating spent catalyst.

A charge 220 corresponding to the FCC feed(s) disclosed with respect to FIGS. 2A and 2B is directed to the FCC zone 288. For instance, the feed can be the liquid effluent stream 92 from the HGN/HCK zone 90, optionally in combination with a slipstream obtained from the stream 97, optionally in combination with another feed 83, and/or optionally in combination with heavies 74 in embodiments in which transalkylation is used, as shown and described with respect to FIG. 2A. Alternatively, the liquid effluent stream 92 from the HGN/HCK zone 90, optionally in combination with a slipstream obtained from the stream 20, optionally in combination with another feed 83, and/or optionally in combination with heavies 74 in embodiments in which transalkylation is used, as shown and described with respect to FIG. 2B.

The charge 220 is conveyed for admixture and intimate contact with an effective quantity of heated fresh or regenerated solid cracking catalyst particles via a conduit 222 from regeneration vessel 218. In certain embodiments the feed is accompanied by steam or other suitable gas for atomization of the feed. The feed mixture and the cracking catalyst are contacted under conditions to form a suspension that is introduced into the riser 212. In a continuous process, the mixture of cracking catalyst and hydrocarbon feedstock proceed upward through the riser 212 into reaction zone 214. In riser 212 and reaction zone 214, the hot cracking catalyst particles catalytically crack relatively large hydrocarbon molecules by carbon-carbon bond cleavage. During the reaction, as is conventional in FCC operations, the cracking catalysts become coked and hence access to the active catalytic sites is limited or nonexistent. Reaction products are separated from the coked catalyst using any suitable configuration known in FCC units, generally referred to as the separation zone 216 in FCC zone 288, for instance, located at the top of the reactor 210 above the reaction zone 214. The separation zone can include any suitable apparatus known to those of ordinary skill in the art such as, for example, cyclones. The reaction product is withdrawn through conduit 224.

Catalyst particles containing coke deposits from fluid cracking of the hydrocarbon feedstock pass from the separation zone 214 through a conduit 226 to regeneration zone 218. In regeneration zone 218, the coked catalyst comes into contact with a stream of oxygen-containing gas, such as pure oxygen or air, which enters regeneration zone 218 via a conduit 228. The regeneration zone 218 is operated in a configuration and under conditions that are known in typical FCC operations. For instance, regeneration zone 218 can operate as a fluidized bed to produce regeneration off-gas comprising combustion products which is discharged through a conduit 230. The hot regenerated catalyst is transferred from regeneration zone 218 through conduit 222 to the bottom portion of the riser 212 for admixture with the hydrocarbon feedstock as noted above.

In general, the operating conditions for the reactor of a suitable riser FCC unit include:

reaction temperature (° C.) of about 450-680, 480-680, 510-680, 550-680, 580-680, 590-680, 450-650, 480-650, 510-650, 550-650, 580-650, 590-650, 450-630, 550-630, 580-630, 590-630, 450-620, 550-620, 580-620 or 590-620;

reaction pressure (bars) of about 1-20, 1-10 or 1-3;

contact time (seconds, in the reactor) of about 0.7-10, 0.7-5, 0.7-2, 1-10, 1-5 or 1-2; and a catalyst to feed ratio (on a mass basis) of about 1:1-40:1, 3:1-40:1, 8:1-40:1, 1:1-30:1, 3:1-30:1, 8:1-30:1, 1:1-20:1, 3:1-20:1, 8:1-20:1, 1:1-15:1, 3:1-15:1, 8:1-15:1, 1:1-10:1, 3:1-10:1 or 8:1-10:1.

A catalyst that is suitable for the particular charge and the desired product is conveyed to the FCC reactor within the FCC reaction and separation zone. In certain embodiments the FCC catalyst includes a solid acid catalyst suitable for cracking hydrocarbons to yield light olefins and FCC naphtha (which can be separated into FCC gasoline and aromatics). For example, suitable solid acid catalysts are Lewis acids, Brønsted acids or a mixture thereof. FCC catalyst systems can be employed with or without FCC catalyst additive to maximize olefin yield. In certain embodiments an FCC catalyst mixture is used in the FCC reaction and separation zone, including an FCC base catalyst and an FCC catalyst additive. In particular, a matrix of a base cracking catalyst can include one or more clays such as kaolin, montmorillonite, halloysite and bentonite, and/or one or more inorganic porous oxides such as alumina, silica, boria, chromia, magnesia, zirconia, titania and silica-alumina. The base cracking catalyst preferably has a bulk density of about 0.5-1.0 g/ml, an average particle diameter of about 50-90 microns, a surface area of about 50-350 $m^2/g$ and a pore volume of about 0.05-0.5 ml/g. A suitable catalyst mixture contains, in addition to a base cracking catalyst, an FCC catalyst additive. The FCC catalyst additive can include a suitable shape-selective zeolite. The shape-selective zeolite referred to herein means a zeolite whose pore diameter is smaller than that of Y-type zeolite, so that hydrocarbons with only limited shape can enter the zeolite through its pores. Suitable shape-selective zeolite components include ZSM-5 zeolite, zeolite omega, SAPO-5 zeolite, SAPO-11 zeolite, SAPO-34 zeolite, and pentasil-type aluminosilicates. In certain embodiments the FCC catalyst additive includes MFI zeolite. The content of the FCC catalyst additive in the additive can be in the range of about 0-70, 5-70, 20-70, 30-70, 0-60, 5-60, 20-60, 30-60, 0-40, 5-40 or 20-40 (based on the total mass of the mixture of catalyst and additive). In certain embodiments the FCC catalyst additive has a bulk density of about 0.5-1.0 g/ml, an average particle diameter of about 50-90 microns, a surface area of about 10-100 $m^2/g$ and a pore volume of about 0.01-0.3 ml/g.

In certain embodiments, the FCC catalyst and/or the catalyst support is prepared in accordance with U.S. Pat. No. 10,357,761 (jointly owned by the owner of the present application, and subject to a joint research agreement), which is incorporated herein by reference in its entirety. The material includes a modified zeolite support having one or more of Ti, Zr and/or Hf substituting the aluminum atoms constituting the zeolite framework thereof. For instance, an effective FCC catalyst can include a framework-substituted zeolite such as an ultra-stable Y-type zeolite, in which a part of aluminum atoms constituting a zeolite framework thereof is substituted one, two or all of Ti, Zr and Hf, for instance 0.1-5 mass % of each calculated on an oxide basis.

Example: A 11.4775 kg sample of an aromatics bottoms stream from an aromatic complex associated with a catalytic reformer is distilled using a laboratory scale true boiling point distillation column with 15 or more theoretical plates using ASTM method D2917. The aromatic bottoms stream was fractioned into 9.411 Kg (82 W %) of a gasoline fraction boiling in the range of IBP, theoretically 36, to 180° C., and 2.066 Kg (18 W %) of a middle and heavy distillate fraction boiling above 180° C. The gasoline fraction was analyzed for its content and octane numbers. Properties and composition of the feed, gasoline fraction and diesel fraction are shown in Table 2.

Figure 4:
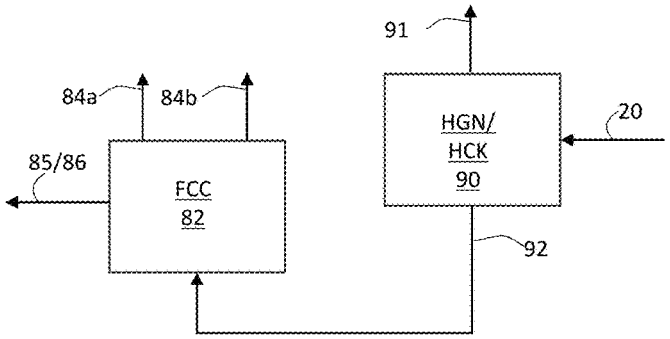
FIG. 4 is a schematic of a portion of a system used in examples of the present disclosure.

FIG. 4 shows a schematic diagram with reference numbers corresponding to those in FIG. 2B for illustration of material balances in the examples below. The aromatic bottoms stream 20 was passed to the HGN/HCK zone 90. Gas effluents 91 were discharged and liquid effluents 92 were directed to the FCC zone 82 to produce a gas stream 84*a* including $C_2$-$C_4$ olefins, a gas stream 84*b* including other gases, and FCC liquid effluent, shown as a single stream 85/86.

TABLE 2

| Property | Feedstock - Aromatic Bottoms (20) | Tops Gasoline IBP - 180° C. (96) | Bottoms Distillate 180° C.+ (97) |
|---|---|---|---|
| Density | 0.8838 | 0.8762 | 0.9181 |
| Octane Number ASTM 02799 | — | 110 | — |
| Cetane Index | — | — | 12 |
| IBP | 153 | 67 | 167 |
| 5 W % | 162 | 73 | 176 |
| 10 W % | 163 | 73 | 181 |
| 30 W % | 167 | 76 | 192 |
| 50 W % | 172 | 77 | 199 |
| 70 W % | 176 | 79 | 209 |
| 90 W % | 191 | 81 | 317 |
| 95 W % | 207 | 81 | 333 |
| FBP | 333 | 83 | 422 |

A non-fractionated aromatic bottoms stream 20 was contacted with a hydrogenation catalyst. The zeolite containing hydrogenation catalyst was prepared as disclosed in U.S. Pat. Nos. 9,221,036 and 10,081,009, which are incorporated by reference, containing platinum as an active phase hydrogenation component. A bed of the hydrogenation catalyst and a bed of hydrocracking catalyst were provided in a pilot plant operating at 300° C., 60 bars of hydrogen partial pressure, and a liquid hourly space velocity of 1.3 $hr^{-1}$. The characteristics of the liquid product effluents 92 are presented in Table 3, as column "A".

The liquid product effluents 92 were sent to the FCC reactor, zone 82, under various temperatures and catalyst-to-oil ratios, to determine the additional yields of light olefins, gasoline, aromatics and cycle oil, using the system of the present disclosure, compared to typical treatment of heavy aromatic bottoms from the aromatics recovery center. The liquid product effluents 92 was subjected to catalytic cracking using a Micro Activity Test (MAT) unit. The MAT tests were conducted in a fixed-bed reactor according to ASTM Standard Test Method D5154 "Determining Activity and Selectivity of FCC Catalysts by Microactivity Test." A CAN-FCC catalyst was used for the tests as disclosed in U.S. Pat. No. 10,357,761, which is incorporated herein by reference. The catalyst was conditioned using the ASTM D4463 method "Metals Free Steam Deactivation of Fresh Fluid Cracking Catalyst". According to this method, the catalyst was aged at 810° C. and ambient pressure under a flow of 100% steam for 6 hours. Four tests were conducted at varying temperatures (600 or 650° C.) at a catalyst to oil ratio of 3 or 6, with characteristics (on a coke free basis) presented in Table 3 as columns 1, 2, 3 and 4.

Feed and product compositions were analyzed by gas chromatography, GC and 2D-GC, as presented in Table 3. The material balances are based on an initial reformate production of 100,000 kg, of which about 15% is typically rejected as heavy aromatic bottoms. Conversion of aromatics into paraffins and naphthenes can be observed showing the extent of the two-stage hydrodearylation during the first part of the integrated process. Additionally, non-condensed and condensed di-aromatic content is reduced with hydrodearylation of the alkyl-bridged non-condensed di-aromatics resulting in mono-aromatics/mono-naphthenes. After subjecting the hydrogenated/hydrocracked product stream to the FCC operation, mono-aromatic recovery is obtained with high levels of BTX/BTEX and light olefin production, as presented in Table 3. The products can be used as petrochemicals and/or recycled gasoline blending components to improve gasoline volume and quality. Further breakdown of the liquid product mono-aromatic species (Table 3) shows xylene and ethyl benzene formation, with a higher selectivity for C8 mono-aromatics relative to toluene and benzene. When subjecting the aromatic bottoms stream to the two-stage hydrodearylation (hydrogenation/low pressure hydrocracking) process (Run A, Table 3) there is a C8 make of 349 kg (2.3% of the aromatic bottoms reject stream). Further processing the hydrogenated/hydrocracked product stream in the integrated FCC unit gives a benzene, toluene and C8 make of: 51 kg (0.34%), 542 kg (3.6%) and 1065 kg (7.1%), respectively for Run 1; 49 kg (0.33%), 605 kg (4.0%) and 1764 kg (11.8%), respectively for Run 2; 75 kg (0.50%), 540 kg (3.6%) and 1019 kg (6.8%), respectively for Run 3; 94 kg (0.63%), 836 kg (5.6%) and 1722 kg (11.5%), respectively for Run 4.

TABLE 3

| | Run | | Feed | A | 1 | 2 | 3 | 4 |
|---|---|---|---|---|---|---|---|---|
| ° C. | Temperature | | — | 300 | 600 | 600 | 650 | 650 |
| bars, $H_2$ partial | Pressure | | — | 60 | — | — | — | — |
| $h^{-1}$ | LHSV | | — | 1.3 | — | — | — | — |
| g/g | Cat/Oil ratio | | — | — | 3 | 6 | 3 | 6 |
| W% relative to liquid effluent | MA | mono-aromatics | 94.1 | 5.82 | 44.79 | 66.91 | 44.13 | 71.26 |
| | B | benzene | 0.00 | 0.00 | 0.62 | 0.69 | 0.99 | 1.56 |
| | T | toluene | 0.00 | 0.00 | 6.56 | 8.53 | 7.16 | 13.90 |
| | X | xylenes | 0.02 | 2.65 | 12.90 | 24.85 | 13.52 | 28.63 |
| | NMA | naphthenic mono-aromatics | 0.9 | 0.34 | 7.79 | 8.04 | 6.4 | 5.45 |
| | MN | mono-naphthenics | 0 | 49.58 | 7.32 | 2.69 | 3.75 | 1.87 |
| | DN | di-naphthenics | 0 | 0 | 0 | 0 | 0 | 0 |
| | P | paraffins | 0 | 39.97 | 12.04 | 4.12 | 5.08 | 2.68 |
| | NDA | naphthenic di-aromatics | 0.9 | 0 | 0.37 | 0.8 | 0.63 | 0.82 |
| | DA | di-aromatics | 1.7 | 0.02 | 2.98 | 6.31 | 3.91 | 7.55 |
| | uDA | uncondensed di-aromatics | 0.22 | 0 | 0.08 | 0.12 | 0.09 | 0.13 |
| | DA/UDA | co-eluted di-aromatics/ Uncondensed di-aromatics | 1.79 | 0 | 0.13 | 0.24 | 0.4 | 0.32 |

TABLE 3-continued

| | Run | | Feed | A | 1 | 2 | 3 | 4 |
|---|---|---|---|---|---|---|---|---|
| | TrA | tri-/tetra-aromatics | 0.2 | 0 | 0 | 0 | 0 | 0 |
| | Olefins | | 0 | 4.27 | 3.22 | 1.16 | 1.29 | 0.74 |
| | Unknown | | 0 | 0 | 21.29 | 9.58 | 34.31 | 9.16 |
| W % relative to gas effluent | Fuel Gas | | — | 23.2 | 1.29 | 4.66 | 4.08 | 4.85 |
| | LPG | | — | 36.8 | 19.8 | 25.6 | 15.8 | 23.9 |
| | Ethylene | | — | 0.01 | 1.27 | 2.10 | 2.52 | 3.37 |
| | Propylene | | — | 0.04 | 7.50 | 8.56 | 10.74 | 12.33 |
| | Butylene | | — | 0.08 | 6.69 | 5.48 | 8.86 | 7.85 |
| | Other Gases | | — | 39.8 | 0 | 0 | 0 | 0 |
| Kg | stream 20 | | 15000 | 15000 | | | | |
| | stream 91 | | — | | | | | |
| | stream 92 | | — | 13159 | 13159 | 13159 | 13159 | 13159 |
| | stream 84a | | — | — | — | — | — | — |
| | stream 84b | | — | — | — | — | — | — |
| | stream 85/86 | | — | — | — | — | — | — |
| stream 91, kg | Fuel Gas | | | 427 | | | | |
| | LPG | | | 678 | | | | |
| | Ethylene | | | 0 | | | | |
| | Propylene | | | 1 | | | | |
| | Butylene | | | 2 | | | | |
| | Other Gases | | | 733 | | | | |
| stream 92, kg | MA | mono-aromatics | — | 766 | 766 | 766 | 766 | 766 |
| | B | Benzene | — | 0 | 0 | 0 | 0 | 0 |
| | T | Toluene | — | 0 | 0 | 0 | 0 | 0 |
| | X | Xylenes | — | 349 | 349 | 349 | 349 | 349 |
| | NMA | naphthenic mono-aromatics | — | 45 | 45 | 45 | 45 | 45 |
| | MN | mono-naphthenics | — | 6524 | 6524 | 6524 | 6524 | 6524 |
| | DN | di-naphthenics | — | 0 | 0 | 0 | 0 | 0 |
| | DA | di-aromatics | — | 3 | 3 | 3 | 3 | 3 |
| | NDA | naphthenic di-aromatics | — | 0 | 0 | 0 | 0 | 0 |
| | P | Paraffins | — | 5260 | 5260 | 5260 | 5260 | 5260 |
| | TrA | tri-/tetra-aromatics | — | 0 | 0 | 0 | 0 | 0 |
| | Olefins | | — | 562 | 562 | 562 | 562 | 562 |
| stream 84a, kg | Ethylene | | — | — | 167 | 276 | 332 | 444 |
| | Propylene | | — | — | 987 | 1126 | 1413 | 1622 |
| | Butylene | — | — | 881 | 721 | 1166 | 1033 | |
| stream 84b, kg | Fuel Gas | | — | — | 169 | 337 | 537 | 638 |
| | LPG | | — | — | 2609 | 3365 | 2079 | 3147 |
| stream 85/86, kg | MA | mono-aromatics | — | — | 3698 | 4749 | 3326 | 4285 |
| | B | benzene | — | — | 51 | 49 | 75 | 94 |
| | T | toluene | — | — | 542 | 605 | 540 | 836 |
| | X | xylenes | — | — | 1004 | 1671 | 956 | 1638 |
| | EB | Ethylbenzene | — | — | 61 | 93 | 63 | 84 |
| | NMA | Naphthenic | — | — | 643 | 571 | 482 | 328 |
| | MN | Mono-naphthenics | — | — | 604 | 191 | 283 | 112 |
| | DN | Di-naphthenics | — | — | 0 | 0 | 0 | 0 |
| | DA | di-aromatics | — | — | 263 | 476 | 332 | 481 |
| | NDA | naphthenic di-aromatics | — | — | 31 | 57 | 47 | 49 |
| | P | paraffins | — | — | 994 | 292 | 383 | 161 |
| | TrA | Tri-/Tetra-aromatics | — | — | 0 | 0 | 0 | 0 |
| | Olefins | | — | — | 266 | 82 | 97 | 45 |
| | Unknown | | — | — | 1758 | 680 | 2586 | 551 |

Accordingly, processing the aromatic bottoms stream within the refinery as disclosed improves its quality. By incorporating the HGN/HCK unit to react the aromatic bottoms or a heavy fraction (for instance the 180+° C. fraction), followed by the FCC unit, additional valuable products are obtained. Non-condensed alkyl multi-aromatics are converted to mono-aromatics, and C8 products are formed. Typically, 15 V % of the reformate sent to aromatics unit ends up in the aromatic bottoms fraction. Considering 100 MBDP reformate capacity, 15 MBDP of low value aromatic bottoms fraction can be converted to valuable products olefins, BTX and gasoline, reformate blending components and/or fuel production blending components/reactants, which is a substantial gain for the refinery.

For the purpose of these simplified schematic illustrations and description, the numerous valves, temperature sensors, electronic controllers and the like that are customarily employed and well known to those of ordinary skill in the art are not included. Accompanying components that are in conventional hydrotreating and reformer units such as, for example, bleed streams, spent catalyst discharge sub-systems, and catalyst replacement sub-systems are also not shown. Further, accompanying components that are in conventional FCC systems such as, for example, air supplies, catalyst hoppers and flue gas handling are not shown.

The methods and systems of the present invention have been described above and in the attached drawings; however, modifications will be apparent to those of ordinary skill in the art and the scope of protection for the invention is to be defined by the claims that follow.

The invention claimed is:

1. A process for treatment of $C_{9+}$, $C_{10+}$ or $C_{11+}$ aromatic bottoms obtained from catalytic reforming of naphtha followed by separation in an aromatic complex into one or more gasoline pool streams, aromatic products and the $C_{9+}$, $C_{10+}$ or $C_{11+}$ aromatic bottoms, the process comprising:

reacting a feedstream comprising all or a portion of the $C_{9+}$, $C_{10+}$ or $C_{11+}$ aromatic bottoms in the presence of a catalyst and hydrogen under specified reaction conditions for hydrogenation and hydrocracking to produce at least liquid effluents; and reacting all or a portion of the liquid effluents in the presence of a catalyst under specified fluidized catalytic cracking reaction conditions to produce FCC naphtha, light olefins and cycle oil.

2. The process as in claim 1, wherein the aromatic complex includes a xylene rerun unit, and wherein the feedstream comprises $C_9$+ alkylaromatics from the xylene rerun unit.

3. The process as in claim 1, further wherein the aromatic complex includes or is in fluid communication with one or more transalkylation reactors for transalkylation of aromatics to produce C8 aromatic compounds and C11+ aromatic compounds, and wherein the feedstream comprises all or a portion of the C11+ aromatics from the one or more transalkylation reactors.

4. The process as in claim 1, further comprising reacting one or more additional streams with the liquid effluent from hydrogenation and hydrocracking under specified fluidized catalytic cracking reaction conditions, wherein the one or more additional streams are selected from a group consisting of vacuum gas oil, demetallized oil, hydrocracker bottoms and atmospheric residue.

5. The process as in claim 1, further comprising passing all or a portion of the FCC naphtha to the catalytic reforming step.

6. The process as in claim 1, further comprising passing all or a portion of the FCC naphtha to the aromatic complex.

7. The process as in claim 1, wherein hydrogenation and hydrocracking occur in multiple beds of different functional catalysts, multiple reaction vessels of different functional catalysts, or a reaction vessel with a mixture of different functional catalysts; and wherein a first functional catalyst is provided for hydrogenation functionality and includes one or more active components selected from a group consisting of Pt, Pd, Ti, Rh, Re, Ir, Ru, and Ni, on a support material selected from a group consisting of alumina, silica-alumina, titania, zeolite, and combinations including two or more the support materials; and a second functional catalyst is provided for hydrocracking functionality and includes one or more active components selected from a group consisting of Co, Ni, W, Mo, on a support material selected from a group consisting of alumina, silica alumina, silica, titania, titania-silica, titania-silicates, zeolite, and combinations including two or more support materials.

8. The process as in claim 1, wherein hydrogenation and hydrocracking occur at a reactor temperature (° C.) in the range of from about 150-450;

under a hydrogen partial pressure (bars) in the range of from about 1-100;

with a hydrogen gas feed rate (SLt/Lt) of about 1-1000; and a liquid hourly space velocity ($h^{-1}$), on a fresh feed basis relative to the catalysts, in the range of from about 0.5-10.0.

9. The process as in claim 8, wherein hydrogenation and hydrocracking occur at a hydrogen partial pressure in the range of about 1-60 bars.

10. The process as in claim 1, wherein hydrogenation and hydrocracking converts alkyl-bridged non-condensed alkyl multi-aromatic compounds into mono-aromatics, and converts a portion of aromatics into paraffins and naphthenes; and wherein fluid catalytic cracking is operable to convert the hydrogenation and hydrocracking liquid effluent into FCC naphtha stream containing BTX/BTEX and light olefin gases.

11. The process as in claim 1, further comprising hydrotreating all or a portion of the FCC naphtha prior to catalytic reforming.

12. The process as in claim 1, wherein the aromatic complex separates reformate into light reformate and heavy reformate separates heavy reformate and FCC naphtha into C7 and C8+ components.

13. The process as in claim 1, further comprising separating all or a portion of the FCC naphtha into aromatics and FCC gasoline.

14. A process for treatment of $C_{9+}$ aromatic bottoms obtained from catalytic reforming of naphtha followed by separation in an aromatic complex into one or more gasoline pool streams, aromatic products and the $C_{9+}$ aromatic bottoms, the process comprising:

separating all or a portion of the $C_{9+}$ aromatic bottoms into one or more tops fractions and one or more bottoms fractions;

reacting a feedstream comprising all or a portion of the bottoms fraction in the presence of a catalyst and hydrogen under specified reaction conditions for hydrogenation and hydrocracking to produce at least liquid effluents; and reacting all or a portion of the liquid effluents in the presence of a catalyst under specified fluidized catalytic cracking reaction conditions to produce FCC naphtha, light olefins and cycle oil.

15. The process as in claim 14, further comprising passing a portion of the $C_9$+ aromatic bottoms to fluidized catalytic cracking.

16. The process as in claim 14, further comprising reacting all or a portion of the tops fractions in the presence of a transalkylation catalyst and hydrogen under specified reaction conditions for transalkylation of aromatics to produce $C_8$ aromatic compounds.

17. The process as in claim 14, wherein the tops fraction comprises $C_9$ and $C_{10}$ aromatic compounds and the bottoms fraction comprises $C_{11}$+ aromatic compounds.

18. The process as in claim 14, wherein the tops fraction comprises $C_9$ aromatic compounds and the bottoms fraction comprises $C_{10}$+ aromatic compounds.

19. The process as in claim 14, wherein the tops fraction comprises naphtha range hydrocarbons and the bottoms fraction comprises diesel range hydrocarbons.

20. The process as in claim 14, wherein the aromatic complex includes a xylene rerun unit, and wherein the feedstream comprises $C_9$+ alkylaromatics from the xylene rerun unit.

21. The process as in claim 14, further wherein the aromatic complex includes or is in fluid communication with one or more transalkylation reactors for transalkylation of aromatics to produce C8 aromatic compounds and C11+ aromatic compounds, and wherein the feedstream comprises all or a portion of the C11+ aromatics from the one or more transalkylation reactors.

22. The process as in claim 14, further comprising reacting one or more additional streams with the liquid effluent from hydrogenation and hydrocracking under specified fluidized catalytic cracking reaction conditions, wherein the one or more additional streams are selected from a group consisting of vacuum gas oil, demetallized oil, hydrocracker bottoms and atmospheric residue.

23. The process as in claim 14, further comprising passing all or a portion of the FCC naphtha to the catalytic reforming step.

24. The process as in claim 14, further comprising passing all or a portion of the FCC naphtha to the aromatic complex.

25. The process as in claim 14, wherein hydrogenation and hydrocracking occur in multiple beds of different functional catalysts, multiple reaction vessels of different functional catalysts, or a reaction vessel with a mixture of different functional catalysts; and wherein a first functional catalyst is provided for hydrogenation functionality and includes one or more active components selected from a group consisting of Pt, Pd, Ti, Rh, Re, Ir, Ru, and Ni, on a support material selected from a group consisting of alumina, silica-alumina, titania, zeolite, and combinations including two or more the support materials; and a second functional catalyst is provided for hydrocracking functionality and includes one or more active components selected from a group consisting of Co, Ni, W, Mo, on a support material selected from a group consisting of alumina, silica alumina, silica, titania, titania-silica, titania-silicates, zeolite, and combinations including two or more support materials.

26. The process as in claim 14, wherein hydrogenation and hydrocracking occur at a reactor temperature (° C.) in the range of from about 150-450;

under a hydrogen partial pressure (bars) in the range of from about 1-100;

with a hydrogen gas feed rate (SLt/Lt) of about 1-1000; and a liquid hourly space velocity ($h^{-1}$), on a fresh feed basis relative to the catalysts, in the range of from about 0.5-10.0.

27. The process as in claim 26, wherein hydrogenation and hydrocracking occur at a hydrogen partial pressure in the range of from about 1-60 bars.

28. The process as in claim 14, wherein hydrogenation and hydrocracking converts alkyl-bridged non-condensed alkyl multi-aromatic compounds into mono-aromatics, and converts a portion of aromatics into paraffins and naphthenes; and wherein fluid catalytic cracking is operable to convert the hydrogenation and hydrocracking liquid effluent into FCC naphtha containing BTX/BTEX and light olefin gases.

29. The process as in claim 14, further comprising hydrotreating all or a portion of the FCC naphtha prior to catalytic reforming.

30. The process as in claim 14, wherein the aromatic complex separates reformate into light reformate and heavy reformate, and separates heavy reformate and FCC naphtha into C7 and C8+ components.

31. The process as in claim 14, further comprising separating all or a portion of the FCC naphtha into aromatics and FCC gasoline.

32. A system comprising:

a catalytic reforming zone comprising one or more reactors and having one or more inlets in fluid communication with a source of naphtha, one or more outlets for discharging gasses containing hydrogen, and one or more outlets for discharging reformate;

an aromatic complex comprising at least one splitter and having one or more inlets in fluid communication with the one or more outlets for discharging reformate, one or more outlets for discharging gasoline pool components, one or more outlets for discharging aromatic products, and one or more outlets for discharging C9+ aromatic complex bottoms;

a hydrogenation and hydrocracking zone comprising one or more reactors and having one or more inlets in fluid communication with a source of hydrogen and one or more outlets for discharging C9+ aromatic complex bottoms, and one or more outlets for discharging liquid effluents; and a fluidized catalytic cracking zone comprising one or more reactors and having one or more inlets in fluid communication with the one or more outlets for discharging liquid effluents, one or more outlets for discharging gases including light olefins, one or more outlets for discharging FCC naphtha, and one or more outlets for discharging cycle oil.

33. The system as in claim 32, further comprising a separation zone comprising a distillation column, a flash unit and/or stripper, and having one or more inlets in fluid communication with the one or more outlets for discharging C9+ aromatic complex bottoms, one or more a outlets for discharging tops fraction components, and one or more outlets for discharging bottoms fraction components, and wherein the one or more inlets of the hydrogenation and hydrocracking zone is in fluid communication with the one or more outlets of the separation zone for discharging bottoms fraction components.

* * * * *